US012669125B2

(12) United States Patent
Jang et al.

(10) Patent No.: US 12,669,125 B2
(45) Date of Patent: Jun. 30, 2026

(54) SCROLL COMPRESSOR AND MANUFACTURING METHOD THEREFOR

(71) Applicant: LG ELECTRONICS INC., Seoul (KR)

(72) Inventors: Kitae Jang, Seoul (KR); Seokhwan Moon, Seoul (KR); Gunyoung Park, Seoul (KR); Jongtae Her, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 6 days.

(21) Appl. No.: 18/851,266

(22) PCT Filed: Jan. 2, 2023

(86) PCT No.: PCT/KR2023/000040
§ 371 (c)(1),
(2) Date: Sep. 26, 2024

(87) PCT Pub. No.: WO2023/210915
PCT Pub. Date: Nov. 2, 2023

(65) Prior Publication Data

US 2025/0188934 A1 Jun. 12, 2025

(30) Foreign Application Priority Data

Apr. 29, 2022 (KR) ..... 10-2022-0053182

(51) Int. Cl.
*F04C 29/12* (2006.01)
*F04C 18/02* (2006.01)

(52) U.S. Cl.
CPC ..... *F04C 29/12* (2013.01); *F04C 18/0215* (2013.01); *F04C 2230/60* (2013.01); *F04C 2240/30* (2013.01)

(58) Field of Classification Search
CPC ..... F04C 18/0215; F04C 2230/60; F04C 2240/30; F04C 28/26; F04C 29/12; F04C 18/0253; F04C 2240/60; F04C 29/124
See application file for complete search history.

(56) References Cited

U.S. PATENT DOCUMENTS

2020/0088197 A1* 3/2020 Kim ..... F04C 18/0215

FOREIGN PATENT DOCUMENTS

JP 06-307357 11/1994
JP 07-012065 1/1995
(Continued)

OTHER PUBLICATIONS

Korean Office Action dated Aug. 22, 2024 issued in Application No. 10-2022-0053182.

(Continued)

*Primary Examiner* — Anthony Ayala Delgado
(74) *Attorney, Agent, or Firm* — KED & ASSOCIATES

(57) ABSTRACT

The present invention provides a scroll compressor and a manufacturing method therefor, the scroll compressor comprising: a housing having a suction space in which a flow path, into which a refrigerant is suctioned, is formed and a flow path accommodation space allowing communication between a compression chamber and the suction space; a rotary shaft provided inside the housing so as to rotate; a compression part having an orbiting scroll orbitally provided at the rotary shaft and a fixed scroll coupled to the orbiting scroll so as to engage therewith, thereby forming the compression chamber between the fixed scroll and the orbiting scroll so that the refrigerant can be discharged; and a variable-capacity member which is provided in the housing so as to allow communication with the flow path accommodation space, and which can open/close at least a portion of the flow path provided therein, so that some of the (Continued)

refrigerant compressed in the compression chamber can make a detour to the suction space through the flow path accommodation space inside the housing.

21 Claims, 17 Drawing Sheets

(56) References Cited

FOREIGN PATENT DOCUMENTS

| | | |
|---|---|---|
| KR | 10-0504889 | 7/2005 |
| KR | 10-2012-0006398 | 1/2012 |
| KR | 10-2014-0012858 | 2/2014 |

OTHER PUBLICATIONS

International Search Report dated Jul. 28, 2023 issued in Application No. PCT/KR2023/000040.

* cited by examiner

SCROLL COMPRESSOR AND MANUFACTURING METHOD THEREFOR

CROSS-REFERENCE TO RELATED PATENT APPLICATIONS

This application is a U.S. National Stage Application under 35 U.S.C. § 371 of PCT Application No. PCT/KR2023/000040, filed Jan. 2, 2023, which claims priority to Korean Patent Application No. 10-2022-0053182, filed Apr. 29, 2022, whose entire disclosures are hereby incorporated by reference.

TECHNICAL FIELD

The present disclosure relates to a scroll compressor and a method of manufacturing the same, and more particularly, to a scroll compressor simplified by changing a structure in which a valve is installed and a flow path of a refrigerant supplied to the valve, and a method of manufacturing the scroll compressor.

BACKGROUND ART

In general, a compressor is applied to a vapor compression type refrigeration cycle (hereinafter, simply referred to as a refrigeration cycle), such as a refrigerator or an air-conditioner. Compressors may be classified into a reciprocal type, a rotary type, a scroll type, and the like according to a method of compressing refrigerant.

Among those compressors, a reciprocal compressor is a compressor in which gas is compressed by a reciprocating motion of a piston within a cylinder, and a scroll compressor is compressor in which a compression chamber is formed between a fixed wrap of a fixed scroll and an orbiting wrap of an orbiting scroll as the orbiting scroll engaged with the fixed scroll, fixed to an inner space of a hermetic case, performs an orbiting motion.

A scroll compressor is configured such that an orbiting scroll and a non-orbiting scroll are engaged with each other and a pair of compression chambers is formed while the orbiting scroll performs an orbiting motion with respect to the non-orbiting scroll.

The compression chamber includes a suction pressure chamber formed at an outer side, an intermediate pressure chamber continuously formed toward a central portion from the suction pressure chamber while gradually decreasing in volume, and a discharge pressure chamber connected to the center of the intermediate pressure chamber. Typically, the suction pressure chamber is formed through a side surface of the non-orbiting scroll, the intermediate pressure chamber is sealed, and the discharge pressure chamber is formed through an end plate portion of the non-orbiting scroll.

Scroll compressors may be classified into a low-pressure type and a high-pressure type according to a path through which refrigerant is suctioned. The low-pressure type is configured such that refrigerant suction pipe is connected to an inner space of a housing to guide suction refrigerant of low temperature to flow into a suction pressure chamber via the inner space of the housing. On the other hand, the high-pressure type is configured such that the refrigerant suction pipe is connected directly to the suction pressure chamber to guide refrigerant to flow directly into the suction pressure chamber without passing through the inner space of the housing.

Meanwhile, there is a growing need for scroll compressors having a variable capacity. To do so, a method of varying a capacity of a compressor by controlling a rotational speed of the compressor is mainly used.

However, since this requires a complex controller, a low-cost and stable variable-capacity device needs to be provided. To do so, methods of varying a capacity of a compressor by returning some of compressed gas from an intermediate pressure chamber to a suction chamber or returning a refrigerant having passed through a condenser to a compression chamber have been widely known.

As an example, Patent Document 1 (Patent Registration No. 10-0504889 (Jul. 29, 2005)) discloses a compressor including a fixed scroll defining an intermediate pressure flow path and a suction pressure flow path, an orbiting scroll engaged with a wrap of the fixed scroll to define a compression chamber together, a bypass pipe coupled to communicate between a gas suction pipe and a gas discharge pipe, a gas guide pipe having one end in communication with a middle portion of the bypass pipe and another end in communication with the intermediate pressure flow path, a flow path switch element installed in a contact point portion between the bypass pipe and the gas guide pipe, a first flow path opening/closing element installed between the gas guide pipe and the intermediate pressure flow path, a refrigerant injection pipe having one end in communication with the suction pressure flow path or the intermediate pressure flow path and another end installed in communication with an outlet of a condenser, a refrigerant injection control valve installed in a middle portion of the refrigerant injection pipe and configured to open/close according to an operating condition, and a second flow path opening/closing element installed between the refrigerant injection pipe and the suction pressure flow path or between the refrigerant injection pipe and the intermediate pressure flow path to guide some of a liquid refrigerant having passed through the condenser to a compression chamber. In the compressor disclosed in Patent Document 1, a discharge amount of compressed gas may be reduced without having to vary a rotational speed of the orbiting scroll to thereby allow to vary a capacity to a low capacity.

In such a scroll compressor in the related art, a refrigerant being compressed is allowed to communicate with a suction side to reduce an amount of the refrigerant to thereby vary a capacity. To do so, valves and pipes are installed outside the scroll compressor in the related art.

Therefore, the compressor in the related art needs to be configured such that valves, pipes, a separate intermediate port for intermediate pressure piping, and a separate suction flow path for suction are disposed outside the compressor.

Thus, due to such an installation, there are problems such that the compressor is complicated, an outer appearance is worsened, and the installation is inconvenient.

DISCLOSURE OF INVENTION

Technical Problem

Therefore, to obviate those problems, the first aspect of the detailed description is to provide a scroll compressor simplified by changing a structure in which a valve is installed and a flow path of a refrigerant supplied to the valve.

In addition, the second aspect of the detailed description is to provide a scroll compressor having a structure in which a valve is installed inside the scroll compressor, and some of refrigerant compressed in a compression chamber is allowed to flow into a suction space through a valve without a separate suction flow path or pipe.

In addition, the third aspect of the detailed description is to provide a scroll compressor capable of including a valve mounting part disposed outside a housing and having a structure in which a valve may be mounted instead of a separate intermediate pressure port.

In addition, the fourth aspect of the detailed description is to provide a scroll compressor having a structure configured to return some of compressed gas from an intermediate compression chamber to a suction chamber to be capable of increasing a discharge amount of the compressed gas without having to vary a rotation speed of an orbiting scroll, thereby allowing to vary a capacity to a low capacity.

Solution to Problem

In order to solve those aspects according to one embodiment, there is provided a scroll compressor including: a housing having a suction space in which a flow path, into which a refrigerant is sucked, is defined, and a flow path accommodation space allowing communication between a compression chamber and the suction space; a rotary shaft installed inside the housing to rotate; a compression part having an orbiting scroll orbitally installed on the rotary shaft and a fixed scroll coupled to the orbiting scroll to engage with the orbiting scroll to define the compression chamber between the orbiting scroll and the fixed scroll so that the refrigerant is dischargeable; and a variable-capacity member installed in the housing to allow communication with the flow path accommodation space and configured to open or close at least a part of a flow path disposed inside so that some of a refrigerant compressed in the compression chamber is bypassed to the suction space through the flow path accommodation space inside the housing.

Thus, some of the refrigerant compressed in the compression part may be bypassed inside the housing to allow to vary a capacity while a configuration of the compressor may be simplified without components such as external valves, ports, etc.

The variable-capacity member may include: a flow path distribution portion configured to receive and accommodate the some of the refrigerant being compressed in the compression chamber to be provided to the suction space; and a valve portion coupled to one side of the flow path distribution portion to open or close a part of the flow path distribution portion to provide the some of the refrigerant accommodated in the flow path distribution portion to the suction space.

According to this configuration, some of refrigerant compressed in the compression chamber may be received through the flow path distribution portion, and the valve portion may be configured to open or close a part of the flow path distribution portion. Thus, the some of the refrigerant compressed in the compression part may be bypassed inside the housing to allow to vary a capacity while a configuration of the compressor may be simplified without components such as external valves, ports, etc.

The variable-capacity member may further include a coupling member coupled to a side portion of the flow path distribution portion and coupled to one side of the housing so that the flow path distribution portion is fixable to the one side of the housing.

Thus, the coupling member may fix the flow path distribution portion to one side of the housing, the valve may be installed inside the scroll compressor, and some of the refrigerant compressed in the compression chamber may be allowed to flow into the suction space through valves without a separate suction flow path or pipe.

A screw thread may be disposed on an outer circumference of the flow path distribution portion to protrude, and a screw thread may be disposed on an inner circumference of the coupling member to be screwed to the screw thread disposed on the outer circumference of the flow path distribution portion.

According to this structure, the flow path distribution portion may be capable of being screwed to the coupling member, and the flow path distribution portion may constitute a structure of being coupled to the housing through the coupling member to define a structure without a separate suction flow path or pipe.

The coupling member may include a flange portion placed outside the housing and disposed to protrude from an outer circumference at one end, and the screw thread on the inner circumference of the coupling member may be disposed on an inner circumference of the flange portion.

Thus, the flow path distribution portion may be capable of being screwed to the inner circumference of the flange portion of the coupling member, and the flow path distribution portion may constitute a structure of being screwed to the housing through the inner circumference of the flange portion of the coupling member to define a structure without a separate suction flow path or pipe.

A coupling hole may be disposed through one surface of the housing and has a screw thread disposed on an inner circumference, and the coupling member may have a screw thread on an outer circumference to be screwed to the inner circumference of the coupling hole.

Thus, the coupling member may be capable of being screwed to the housing, and constitute a structure without a separate suction flow path or pipe.

The housing may have a coupling hole which is disposed through one surface of the housing and into which the coupling member is inserted, the coupling member may include a flange portion placed outside the housing and disposed to protrude from an outer circumference at one end, the flange portion may be equipped with a bolt coupling hole in which a bolt is accommodated, and a bolt hole in communication with the bolt coupling hole may be disposed in one surface of the housing, and bolts are fastened into the bolt coupling hole and the bolt hole to couple the coupling member to the one surface of the housing by the bolts.

Thus, the coupling member may be bolted to the housing, and a structure without a separate suction path or pipe may be configured.

The flow path distribution portion may include: an inlet portion having one open side into which a refrigerant under an intermediate pressure in the compression chamber is received and introduced; an inlet flow path which communicates with the inlet portion and into which a refrigerant provided from the inlet portion flows; an outlet flow path which communicates with the inlet flow path and through which the flowing refrigerant flows out into the suction space; and a blocking portion disposed between the inlet flow path and the outlet flow path and capable of being opened or closed by the valve portion.

The flow path distribution portion may have one end coupled to a communication tube being in communication between the outlet flow path and the suction space, the one end being connected to the outlet flow path.

According to this structure, some of the refrigerant compressed in the compression chamber may be received through the inlet portion of the flow path distribution portion and may be allowed to flow into the suction space through the inlet flow path, the outlet flow path, and the communication tube, and the valve portion allows a part of the flow path distribution portion to be opened or closed, thereby causing some of the refrigerant compressed in the compression section to be bypassed inside the housing to allow to vary a capacity, while a configuration of the compressor may be simplified without components such as external valves, ports, etc.

In the present disclosure, the flow path accommodation space may be defined by one side of the fixed scroll and an inner side of the housing, the one side being opposite to another side of the fixed scroll toward which the orbiting scroll is disposed, the suction space may be disposed between the compression part and a side portion of the housing, a communication hole may be disposed in the fixed scroll to communicate between the flow path accommodation space and the suction space, and the communication tube may be inserted into the communication hole.

In addition, a bypass guide groove in communication with the compression chamber and defined by inside of the housing may be disposed in the one side of the fixed scroll, the one side being opposite to the another side of the fixed scroll toward which the orbiting scroll is disposed, and an inlet hole in communication with the flow path accommodation space may be disposed in the bypass guiding groove.

According to this structure, some of the refrigerant in the compression chamber may be provided to the flow path distribution portion through the bypass guide hole and the inlet hole via the flow path accommodation space.

The flow path distribution portion may be placed inside the housing to communicate with an inner side of the housing, and the valve portion may be coupled to the flow path distribution portion to be disposed to protrude toward outside of the housing.

However, the flow path distribution portion and the valve portion may be disposed inside the housing.

The fixed scroll may have a flow path distribution accommodating portion disposed concavely on one surface, opposite to a side in which the compression chamber is disposed, such that the flow path distribution portion is inserted into the one surface, and the flow path distribution portion may be coupled to the flow path distribution accommodating portion.

Thus, the flow path distribution portion and the valve portion may be placed inside the housing, and the flow path distribution portion may be coupled to the flow path distribution accommodating portion. Accordingly, the compressor may have a simple structure.

The flow path distribution portion may have a screw thread on an outer circumference and the flow path distribution accommodating portion has a screw thread on an inner circumference, and the flow path distribution portion may be screwed to the flow path distribution accommodating portion.

Thus, the flow path distribution portion and the valve portion may be arranged inside the housing, and the flow path distribution portion may be coupled to the flow path distribution accommodating portion by screwing. Accordingly, the compressor may have a simple structure.

The flow path distribution portion may include: an inlet portion having one open side into which a refrigerant under an intermediate pressure in the compression chamber is received and introduced; an inlet flow path which communicates with the inlet portion and into which a refrigerant provided from the inlet portion flows; an outlet flow path which communicates with the inlet flow path and through which the flowing refrigerant flows out into the suction space; and a blocking portion disposed between the inlet flow path and the outlet flow path and capable of being opened or closed by the valve portion.

According to this structure, some of the refrigerant compressed in the compression chamber may be received through the inlet portion of the flow path distribution portion and may be allowed to flow into the suction space through the inlet flow path, the outlet flow path, and the communication tube, and the valve portion allows a part of the flow path distribution portion to be opened or closed, thereby allowing some of the refrigerant compressed in the compression section to be bypassed inside the housing to allow to vary a capacity, while a configuration of the compressor may be simplified without components such as external valves, ports, etc.

The flow path distribution portion may have one end coupled to a communication tube being in communication between the outlet flow path and the suction space, the one end being connected to the outlet flow path.

A bypass guide groove in communication with an intermediate pressure chamber of the compression chamber and defined by inside of the housing may be disposed in one surface of the fixed scroll, and an inlet hole in communication between the inlet portion and the bypass guide groove may be disposed in the flow path distribution accommodating portion.

According to this structure, some of the refrigerant in the compression chamber may be provided to the flow path distribution portion through the bypass guide hole and the inlet hole via the flow path accommodation space.

A guide portion configured to guide introduction of the refrigerant into the flow path distribution portion may be disposed on an inner circumference of the coupling member.

In order to solve those problems according to another embodiment, there is provided a method of manufacturing a scroll compressor, the method including: coupling a valve portion and a flow path distribution portion, coupled to each other, to a coupling member; mounting a coil to an outer circumference of the valve portion; and coupling the coupling member to one surface of a housing.

The coupling of the valve portion and the flow path distribution portion to the coupling member may include screwing an outer circumference of the flow path distribution portion to an inner circumference of the coupling member.

Thus, the flow path distribution portion may be screwed to an inner circumference of the flange portion of the coupling member, and the flow path distribution portion may constitute a structure of being screwed to the housing through the inner circumference of the flange portion of the coupling member to define a structure without a separate suction flow path or pipe.

The coupling of the coupling member to the one surface of the housing includes screwing an inner circumference of a coupling hole of the housing to an outer circumference of the coupling member.

Thus, the coupling member may be screwed to the housing, and constitute a structure without a separate suction flow path or pipe.

Desirably, the coupling of the coupling member to the one surface of the housing may include: inserting the coupling member into a coupling hole of the housing; and bolting a flange portion of the coupling member to the one surface of the housing.

Thus, the coupling member may be bolted to the housing, and a structure without a separate suction path or pipe may be configured.

Advantageous Effects of Invention

In the scroll compressor in the present disclosure, some of refrigerant being compressed is caused to flow into a suction space to vary a capacity simply by mounting a valve without having to dispose a valve, a pipe, a separate intermediate pressure port for intermediate pressure piping, and a separate suction path for suction outside the scroll compressor.

In addition, in the scroll compressor in the present disclosure, a variable-capacity member may be is installed in a housing and a passage in communication with the variable-capacity member is disposed. Thus, a refrigerant being compressed inside may communicate with suction to reduce an amount of the refrigerant to allow to vary a capacity.

In addition, in the scroll compressor in the present disclosure, some of refrigerant compressed in the compression chamber may be received through the flow path distribution portion, and the valve portion may be configured to open or close a part of the flow path distribution portion. Thus, some of the refrigerant compressed in the compression part may be bypassed inside the housing to allow to vary a capacity while a configuration of the scroll compressor may be simplified without components such as external valves, ports, etc.

A bypass guide groove may be included in the fixed scroll and an inlet hole may be disposed in the flow path distribution portion. Thus, some of the refrigerant in the compression chamber may be provided to the flow path distribution portion through the bypass guide hole and the inlet hole via the flow path accommodation space.

MODE FOR THE INVENTION

Hereinafter, description will be given in more detail of a scroll compressor 100 according to the present disclosure, with reference to the accompanying drawings.

For the sake of brief description with reference to the drawings, the same or equivalent components may be provided with the same or similar reference numbers, and description thereof will not be repeated.

In addition, a structure that is applied to one embodiment will be equally applied to another embodiment as long as there is no structural and functional contradiction in the different embodiments.

A singular representation may include a plural representation unless it represents a definitely different meaning from the context.

In describing the present disclosure, if a detailed explanation for a related known function or construction is considered to unnecessarily divert the gist of the present disclosure, such explanation has been omitted but would be understood by those skilled in the art.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Figure 1:
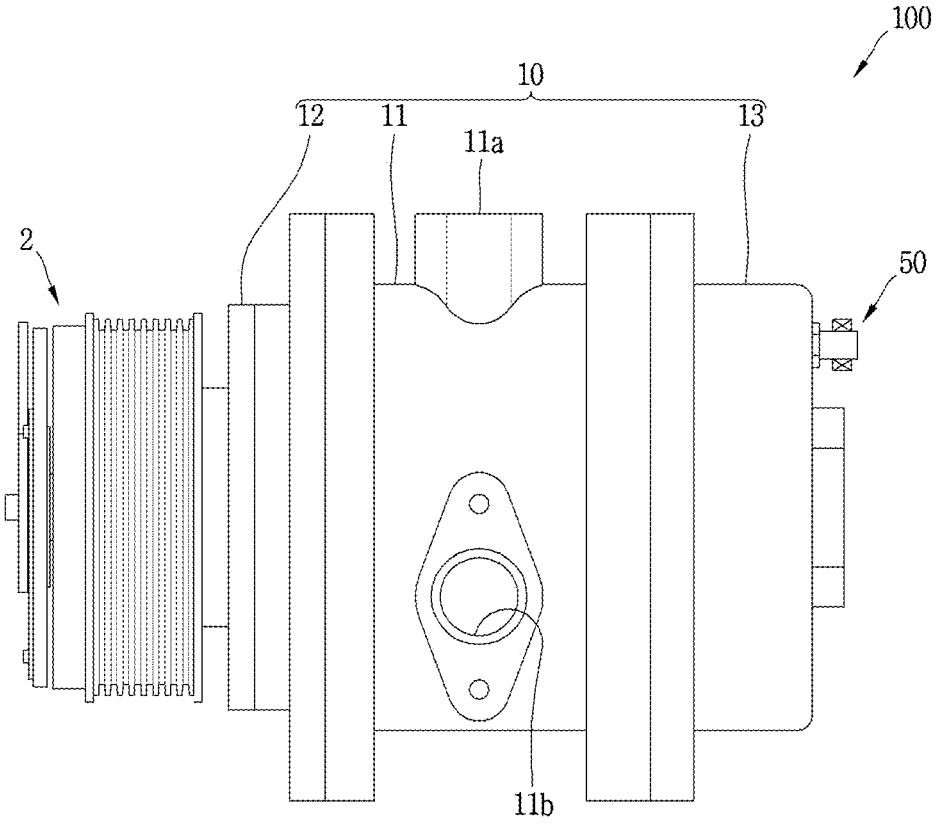
FIG. 1 is a front view illustrating a scroll compressor according to the present disclosure.
Figure 2:
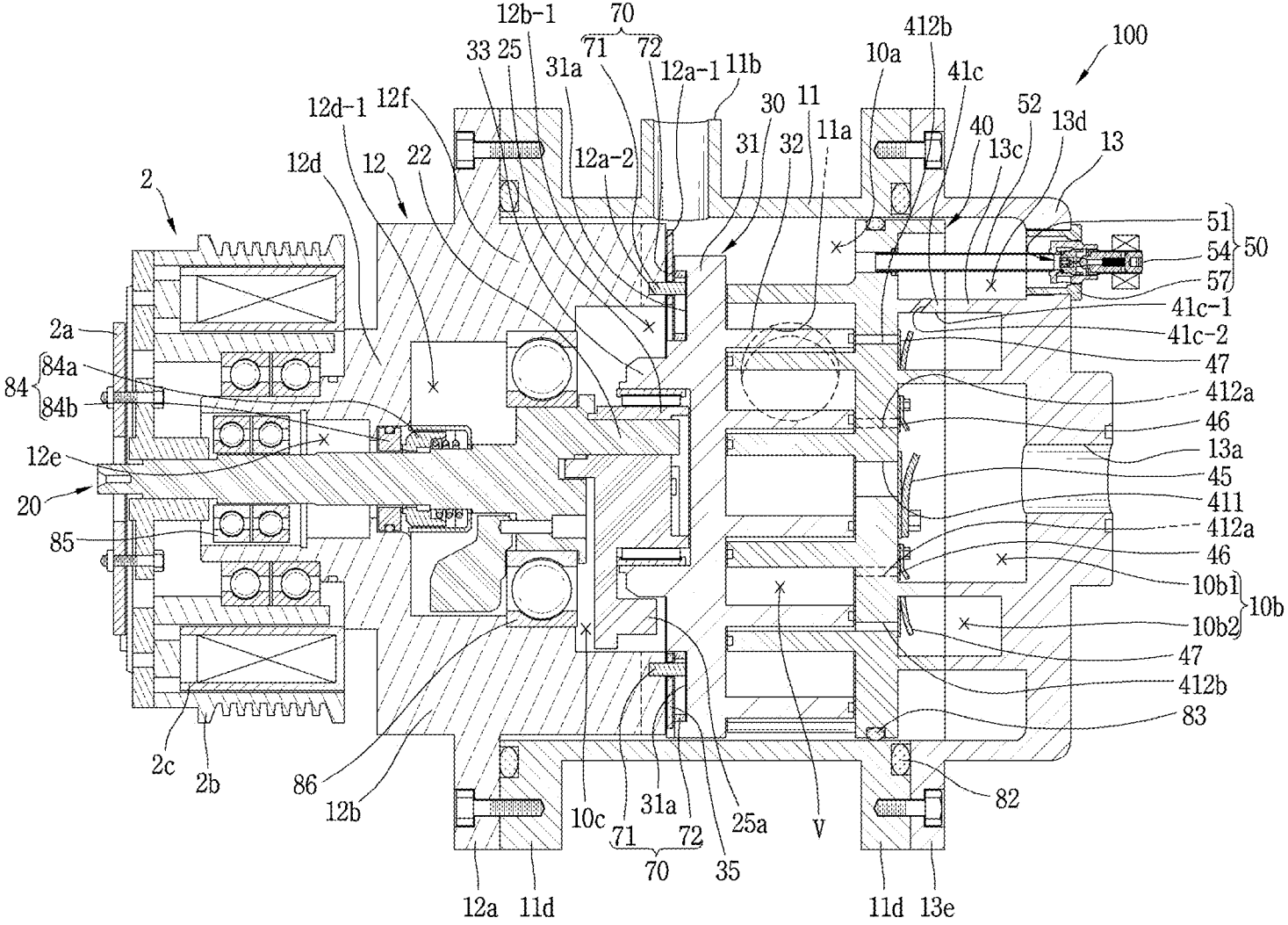
FIG. 2 is a sectional view illustrating the scroll compressor according to the present disclosure.
Figure 3:
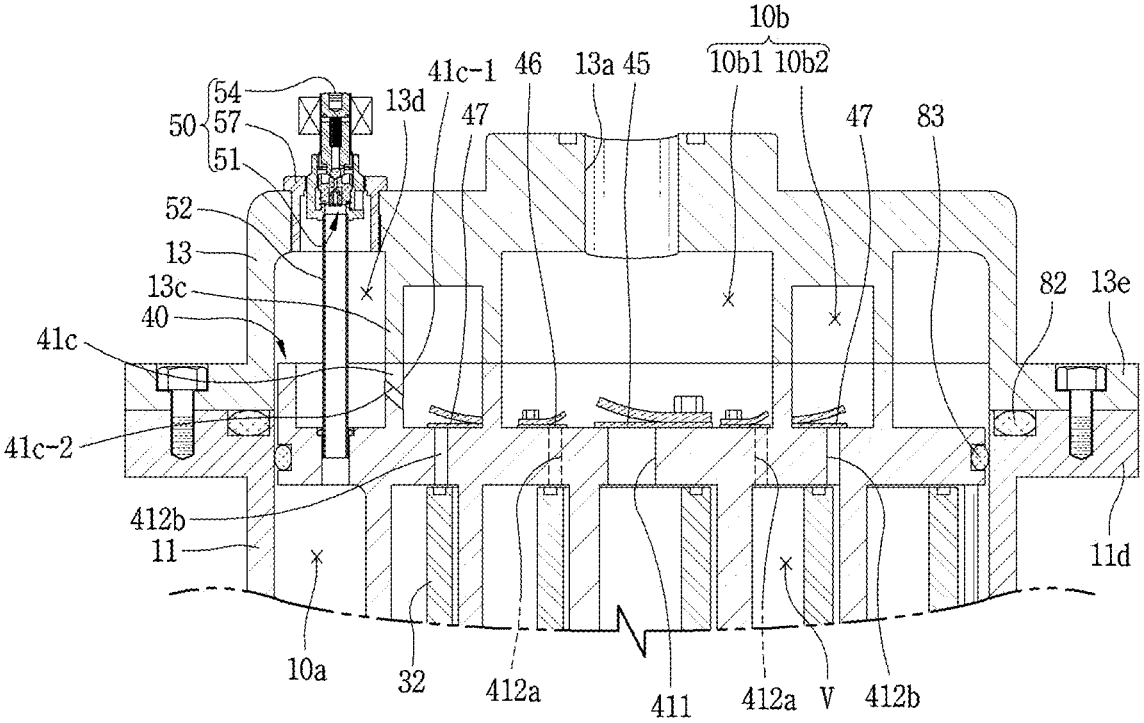
FIG. 3 is a sectional view illustrating an upper portion of FIG. 2.
Figure 4:
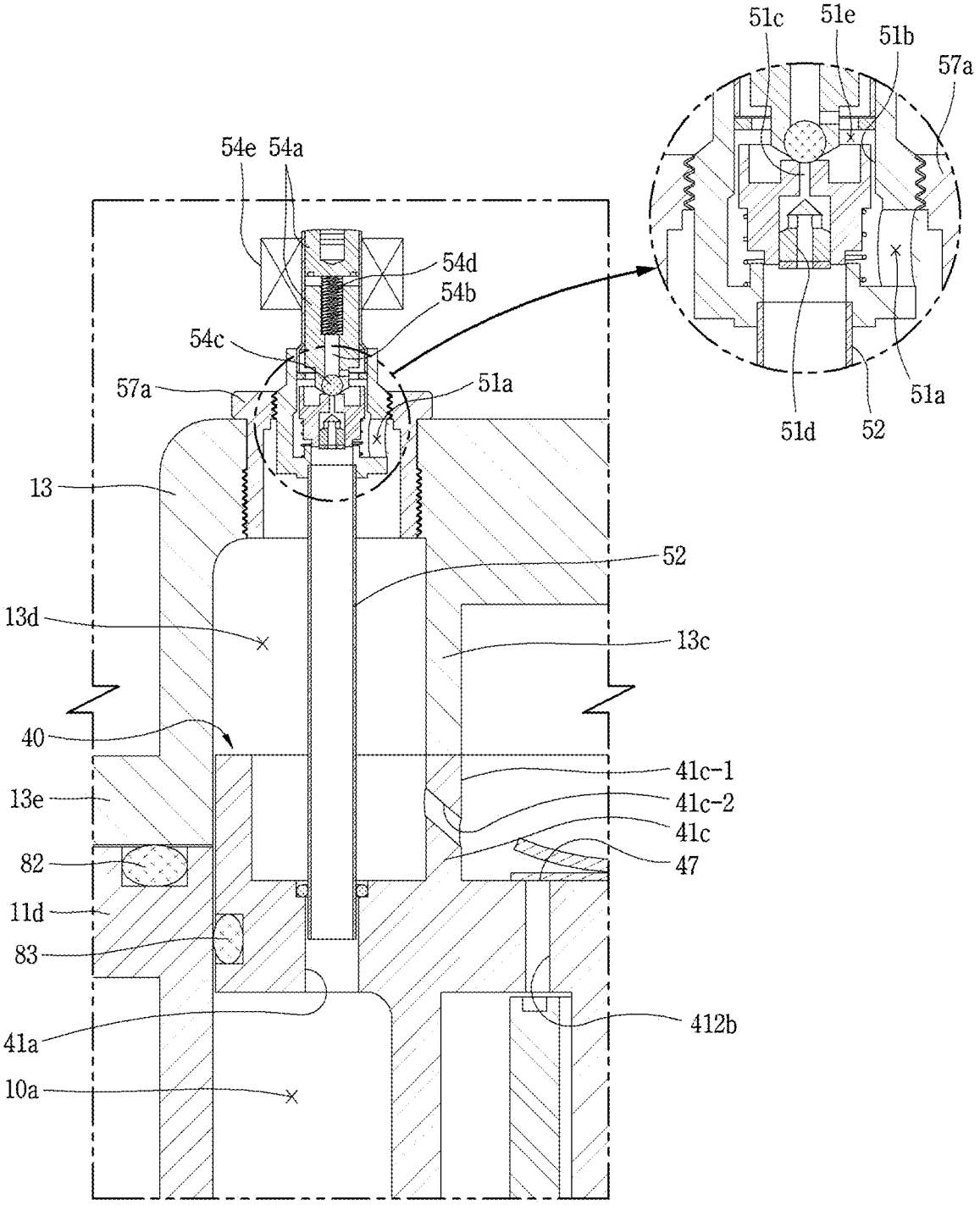
FIG. 4 is an enlarged sectional view illustrating a portion in which a variable-capacity member of FIG. 3 is installed.
Figure 5:
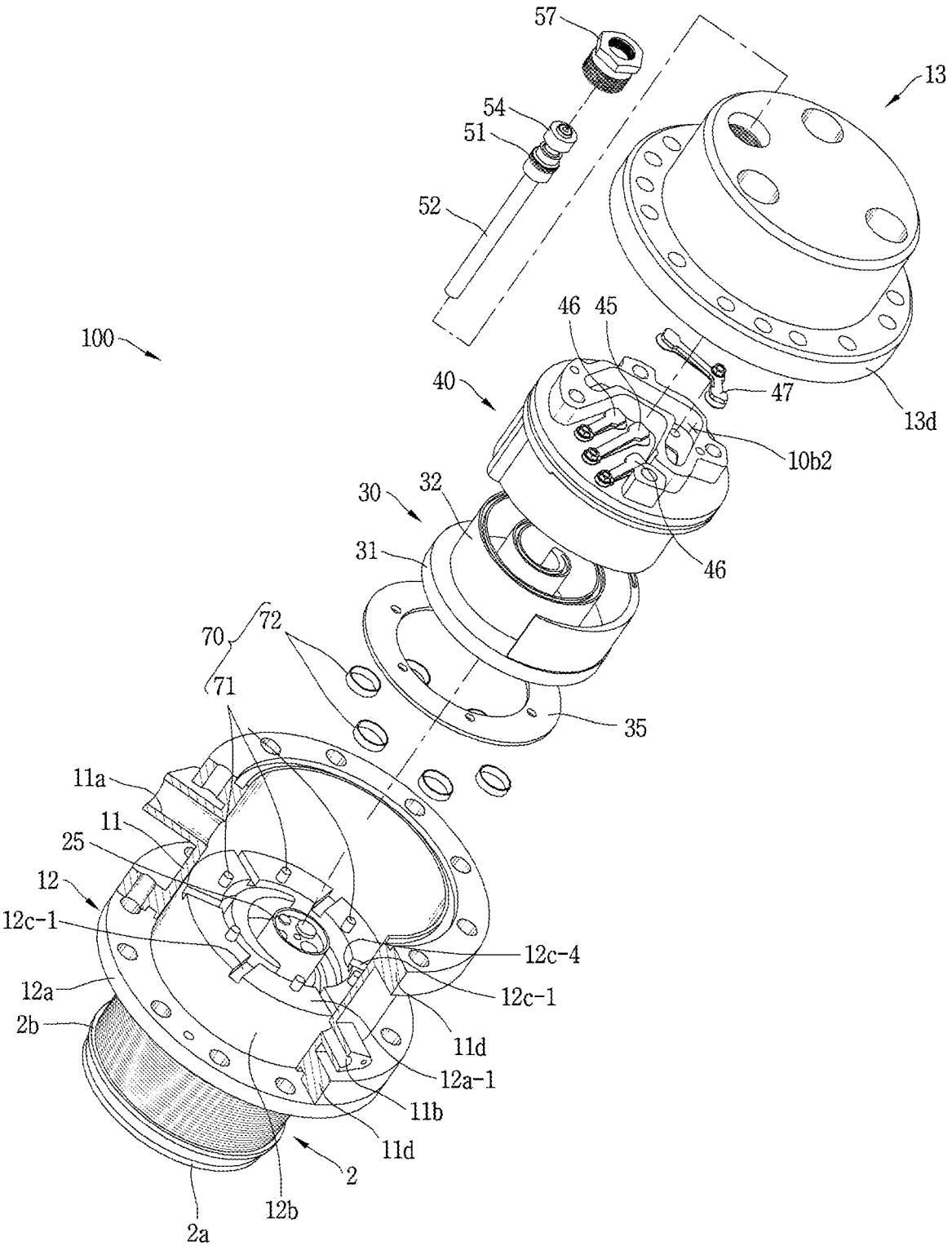
FIG. 5 is an exploded perspective view illustrating a part of the scroll compressor according to the present disclosure.

FIG. 1 is a front view illustrating a scroll compressor 100 according to the present disclosure. FIG. 2 is a sectional view illustrating the scroll compressor 100 according to the present disclosure. FIG. 3 is a sectional view illustrating an upper portion of FIG. 2. FIG. 4 is an enlarged sectional view illustrating a portion in which a variable-capacity member 50 of FIG. 3 is installed. FIG. 5 is an exploded perspective view illustrating a part of the scroll compressor 100 according to the present disclosure.

Hereinafter, the scroll compressor 100 in the present disclosure will be described with reference to FIGS. 1 to 5.

The scroll compressor 100 in the present disclosure may be a horizontal type scroll compressor.

The scroll compressor 100 in the present disclosure includes a housing 10, a rotary shaft 20, a compression part, and a variable-capacity member 50.

The housing 10 includes a suction space 10*a* in which a flow path through which a refrigerant is sucked is defined, and a flow path accommodation space 13*d* in communication between a compression chamber and the suction space 10*a*.

The rotary shaft 20 is equipped inside the housing 10 to rotate.

The compression part includes an orbiting scroll 30 orbitally installed at the rotary shaft 20, and a fixed scroll 40 coupled to be engaged with the orbiting scroll 30 to define a compression chamber between the rotating scroll 30 and the fixed scroll 40 to allow to discharge a refrigerant.

The variable-capacity member 50 is installed in the housing 10 to allow some of a refrigerant compressed in the compression chamber to make a detour (i.e., bypass) to the suction space 10*a* through the flow path accommodation space 13*d*.

Detailed configurations of the housing 10, the rotary shaft 20, the compression part, and the variable-capacity member 50 will be described later.

First, referring to FIGS. 2 and 5, the orbiting scroll 30 is described.

The orbiting scroll 30 is disposed to be capable of performing an orbital motion relative to the fixed scroll 40.

The orbiting scroll 30 is disposed to define a compression chamber V together with the fixed scroll 40.

The orbiting scroll 30 may include an orbiting wrap 32 engaged with a fixed wrap 42 of the fixed scroll 40 to define the compression chamber V, an orbiting end plate 31 connected to one end of the orbiting wrap 32 to have a predetermined width, and a shaft coupling portion 33 disposed in the orbiting plate portion 31 in a direction opposite to the orbiting wrap 32.

The orbiting scroll 30 is disposed in a position facing the fixed scroll 40. The orbiting scroll 30 is coupled to an eccentric bush 25 of the rotary shaft 20. Accordingly, the orbiting scroll 30 is orbitally coupled to the rotary shaft 20.

When receiving rotational force through the eccentric bush 25, the rotary scroll 30 performs an orbiting motion by an anti-rotation member 70.

For example, the orbiting scroll 30 may be made of aluminum or an alloy including aluminum to facilitate a high-speed orbiting motion.

In the present disclosure, the orbiting scroll 30 shown in FIGS. 2 and 5 may be made of a same material as that of a front housing 12. In this case, a thrust plate 35 is arranged between the orbiting scroll 30 and the front housing 12.

On the other hand, the orbiting scroll 30 may be made of a material different from that of the front housing 12. In this case, the orbiting scroll 30 may be in direct friction with the front housing 12, and a structure in which a separate thrust plate between the orbiting scroll 30 and the front housing 12 is not needed may be configured.

The orbiting scroll 30 includes the orbiting end plate 31, the orbiting wrap 32, the shaft coupling portion 33, and a ring accommodating groove 31*a*.

The orbiting end plate 31 is configured to have a plate shape corresponding to a fixed end plate 41 to be described later. When the orbiting end plate 31 has a section corresponding to a circle, the orbiting end plate 31 has a disk shape.

The orbiting end plate 31 may be seated on the fixed wrap 42 of the fixed scroll 40. In addition, the orbiting end plate 31 and the fixed wrap 42 may define a thrust surface.

Among both surfaces of the orbiting end plate 31, when a surface facing the front housing 12 is referred to as a first surface and another surface facing the fixed scroll 40 is referred to as a second surface, the ring accommodating groove 31*a* is disposed in the first surface and the orbiting wrap 32 is disposed on the second surface.

FIG. 2 illustrates an example in which the ring accommodating groove 31*a* is disposed in left and right sides of the first surface (with reference to a section) in a lower portion of the orbiting end plate.

The first surface may be understood as a surface connected to the front housing 12.

The ring accommodating groove 31*a* may be disposed in plurality, and the plurality of ring accommodating grooves 31*a* may be spaced apart from each other in a circumferential direction on the orbiting end plate 31 of the orbiting scroll 30.

An anti-rotation ring 72 may be coupled into the ring accommodating groove 31*a* using a press-fitting method. However, the present disclosure is not limited to the press-fitting method, and coupling may be performed using other methods such as a screwing method.

An anti-rotation pin 71, which will be described later, may be orbitally installed in the anti-rotation ring 72 coupled into the ring accommodating groove 31*a*. The anti-rotation ring 72 is configured to perform an orbiting motion relative to the anti-rotation pin 71.

The ring accommodating groove 31*a* may be configured to have a closed circular shape, or in some cases, may be configured in an arcuate shape having an open part of a circumference. The ring accommodating groove 31*a* may be configured to have a circular shape.

Due to such a structure of the anti-rotation pin 71 and the anti-rotation ring 72, the orbiting scroll 30 may be prevented from rotating between the front housing 12 and the fixed scroll 40 to be capable of perform an orbiting motion.

The orbiting wrap 32 protrudes from the second surface of the orbiting end plate 31 toward the fixed scroll 40 to have a shape of an involute curve, an Archimedean spiral, or a logarithmic spiral. The orbiting wrap 32 may be configured in other various shapes.

The orbiting wrap 32 may be in close contact with the fixed end plate 41. Likewise, the fixed wrap 42 may be in close contact with the orbiting end plate 31. A tip chamber may be installed on at least one of an axial end of the fixed wrap 42 and an axial end of the orbiting wrap 32 to seal the compression chamber V.

The shaft coupling portion 33 is disposed at a center of the orbiting end plate 31. The shaft coupling portion 33 protrudes from the first surface of the orbiting end plate 31 toward the fixed scroll 40. The shaft coupling portion 33 may be disposed in a position corresponding to a base circle having an involute shape defining the orbiting wrap 32. Accordingly, the shaft coupling portion 33 defines an innermost part of the orbiting wrap 32.

The orbiting wrap 32 may extend up to an outer circumferential surface of the orbiting end plate 31. Thus, a wrap length of the orbiting wrap 32 may extend at maximum, thereby maximizing suction volume.

Additionally, the shaft coupling portion 33 may be configured to have a cylindrical shape to accommodate the eccentric bushing 25 installed on the rotary shaft 20. Alternatively, the shaft coupling portion 33 may be understood as having a boss shape. The shaft coupling portion 33 may be disposed to surround the eccentric bushing 25 installed on the rotary shaft 20.

A third bearing may be disposed between an inner circumferential surface of the shaft coupling portion 33 and an outer circumferential surface of the eccentric bushing 25. Referring to FIG. 2, an example in which the third bearing configured as a needle bearing is shown. However, the third bearing is not necessarily limited thereto, and may be a bushing bearing or a ball bearing.

The fixed scroll 40 and the orbiting scroll 30 are combined with each other to constitute a pair of compression chambers V. As the rotary scroll 30 performs an orbiting motion, volume of the compression chambers V is repeatedly changed, and accordingly, a fluid such as a refrigerant is compressed in the compression chambers V.

The fixed scroll 40 is placed relatively far away from the rotary shaft 20, and the orbiting scroll 30 is placed relatively close to the rotary shaft 20. The fixed scroll 40 is located between the orbiting scroll 30 and a rear housing 13 in an axial direction. In addition, the orbiting scroll 30 is located between the fixed scroll 40 and the front housing 12 in an axial direction.

In the scroll compressor 100 in the present disclosure, the housing 10 may include the front housing 12, a middle housing 11, and the rear housing 13. FIG. 2 shows an example in which the front housing 12, the middle housing 11, and the rear housing 13 are configured as separate members. However, the present disclosure is not limited thereto, and the housing 10 may be configured as a single member.

As illustrated in FIG. 2, the front housing 12, the middle housing 11, and the rear housing 13 may constitute the housing 10 defining an outer appearance of the scroll compressor 100 in the present disclosure.

The fixed scroll 40 is supported by the middle housing 11 in a radial direction of the rotary shaft 20. In addition, the fixed scroll 40 is supported by the rear housing 13 in an axial direction of the rotary shaft 20.

The orbiting scroll 30 is disposed to face the fixed scroll 40. The orbiting scroll 30 is coupled to an eccentric bush 25 on the rotary shaft 20. Accordingly, the orbiting scroll 30 is eccentrically coupled to the rotary shaft 20 to rotate eccentrically rather than concentrically. That is, the orbiting scroll 30 is coupled to the eccentric bush 25 to receive rotational force through the eccentric bush 25, and the orbiting scroll 30 is guided by the anti-rotation member 70 to be prevented from being rotated and allowed to perform an orbiting motion.

As such, the fixed scroll 40 is positioned to face the orbiting scroll 30. Since the orbiting scroll 30 is axially supported by the front housing 12, it may be understood that the fixed scroll 40 has a structure of being indirectly supported by the front housing 12 in an axial direction.

In detail, the fixed scroll 40 includes the fixed end plate 41 and the fixed wrap 42.

The fixed plate part 41 is configured such that an outer circumference is fixedly coupled to an inner circumference of the middle housing 11 and an upper portion with reference to FIG. 2 is supported by the rear housing 13. In addition, the fixed end plate 41 is configured in a plate shape. The fixed end plate 41 may have a circular section, and in this case, the fixed plate portion 41 has a disk shape.

Among both surfaces of the fixed end plate 41, when a surface facing the rear housing 13 is referred to as a first surface and another surface facing the orbiting scroll 30 is referred to as a second surface, a partition protrusion 41*c* and a bypass guide groove 41*c*-1 are disposed on the first surface and the fixed wrap 42 is disposed on the second surface.

The fixed wrap 42 protrudes toward the orbiting scroll 30 to have a shape of an involute curve, an Archimedean spiral, or a logarithmic spiral. The fixed wrap 42 may be configured in other various shapes. The fixed wrap 42 is engaged with the orbiting wrap 32 to define the compression chambers V.

A discharge port 411 is disposed at a center of the fixed end plate 41. Referring to FIG. 2, in the present embodiment, an example in which one discharge port 411 is disposed in a center portion of the fixed end plate 41 is shown.

At least one of bypass holes 412*a* and 412*b* may be disposed in a periphery of the discharge port 411.

As an example, the bypass holes 412*a* and 412*b* may include a first bypass hole 412*a* for suppressing overcompression and/or a second bypass hole 412*b* for varying a capacity.

The first bypass hole 412*a* may be disposed independently in each compression chamber V in a periphery of the discharge port 411.

Additionally, the second bypass hole 412*b* may be independently disposed in each compression chamber V to be farther from the discharge port 411 than the first bypass hole 412*a*.

The discharge port 411, the first bypass hole 412*a*, and the second bypass hole 412*b* may be opened or closed by valves, respectively. For example, the discharge port 411 may be opened or closed by a discharge valve 45, the first bypass hole 412*a* by a first bypass valve 46, and the second bypass hole 412*b* by a second bypass valve 47.

Figure 6:
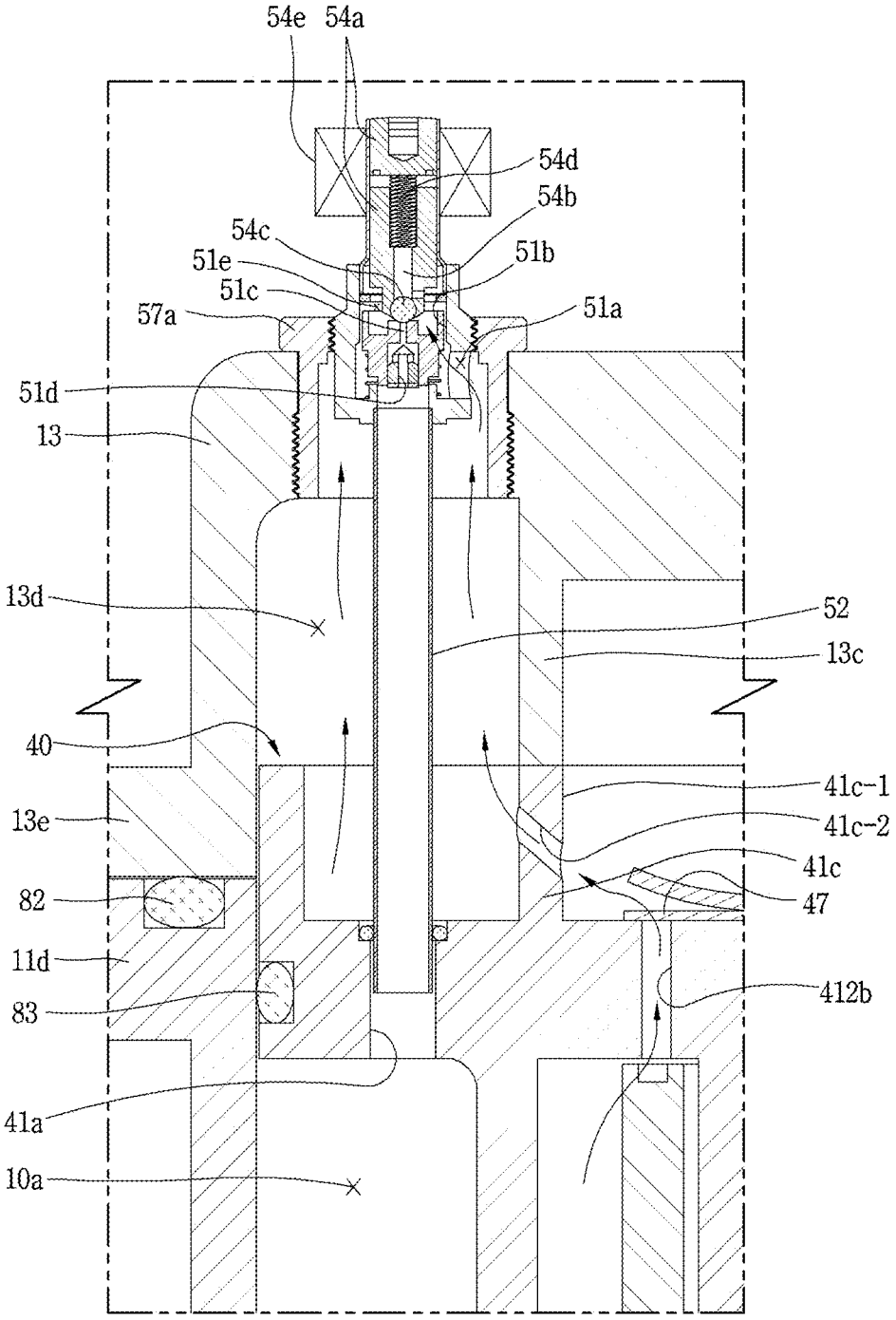
FIG. 6 is a sectional view illustrating an example in which a flow path distribution portion is closed by a valve portion of the variable-capacity member.
Figure 7:
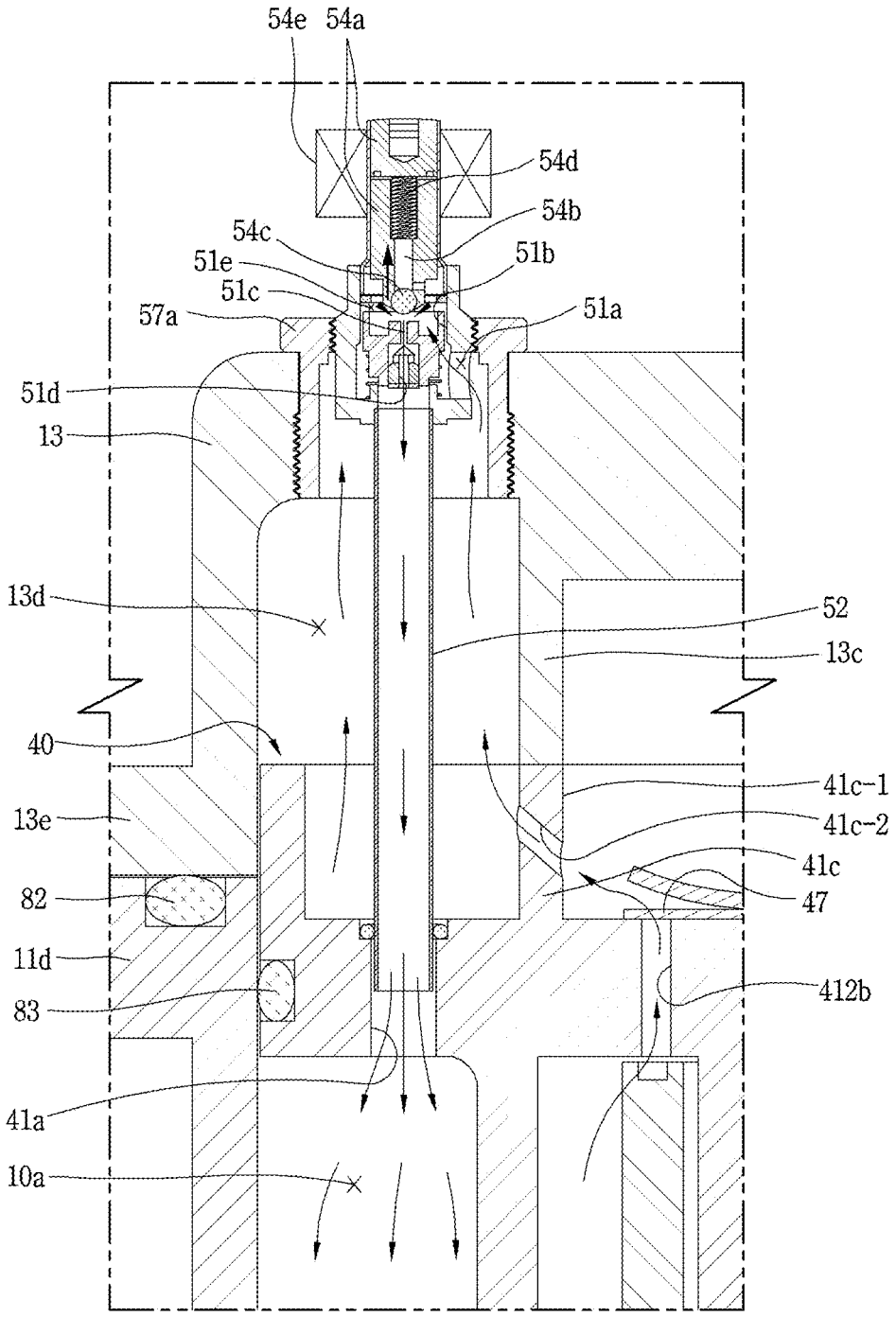
FIG. 7 is a sectional view illustrating an example in which the flow path distribution portion is opened by the valve portion of the variable-capacity member.

As illustrated in FIG. 4, the second bypass hole 412*b* may be opened or closed by the second bypass valve 47 to cause some of a refrigerant in a compression chamber, i.e., an intermediate pressure refrigerant to be provided to the flow path accommodation space 13*d* through an inlet hole 41*c*-2, and then, provided to the suction space 10*a* via the inlet portion 51*a*, an outlet flow path 51*d*, and a communication tube 52 each included in a flow path distribution portion 51 (FIGS. 6 and 7).

The discharge valve 45, the first bypass valve 46, and the second bypass valve 47 may be configured independently, or some of such valves may be connected to each other to be integrally disposed. In the present embodiment, the discharge valve 45, the first bypass valve 46, and the second bypass valve 47 may be disposed independently and coupled to each other.

Meanwhile, a discharge space 10*b* may be defined between a rear surface of the fixed end plate 41 and an inner space of the rear housing 13 facing the rear surface of the fixed end plate 41. The discharge space 10*b* may be divided into a first discharge space 10*b*1 and a second discharge space 10*b*2. For example, the partition protrusion 41*c* extending toward the rear housing 13 by a preset height may disposed on the rear surface of the fixed end plate 41.

The partition protrusion 41*c* may be configured in a ring shape having approximately a V shape when projected in an axial direction to separate the first discharge space 10*b*1 from the second discharge space 10*b*2. For example, the first discharge space 10*b*1 may be disposed outside the partition protrusion 41*c*, and the second discharge space 10*b*2 may be disposed inside the partition protrusion 41*c*, respectively.

The first discharge space 10*b*1 may communicate with a refrigerant discharge port 13*a* described above, and the second discharge space 10*b*2 may communicate with the flow path accommodation space 13*d* described above. That is, the second discharge space 10*b*2 may also be understood as a space for accommodating a refrigerant to enable bypass.

The discharge valve 45 and the first bypass valve 46 belong to the first discharge space 10*b*1, and the second bypass valve 47 belongs to the second discharge space 10*b*2.

Accordingly, the first discharge space 10*b*1 allows a refrigerant to be discharged from a discharge pressure chamber (in communication with the first discharge space, as shown in a middle part of FIG. 2) of both the compression chambers V and guided to a condenser 20 in a refrigeration cycle.

The second discharge space 10*b*2 defines a kind of a bypass space in which a refrigerant bypassed from an intermediate pressure chamber (a second intermediate pressure chamber having a lower pressure than that of the first intermediate pressure chamber, as shown on a side portion of the compression chamber in FIG. 2) of both the compression chambers V returns to the suction space 10*a* of the housing 110 via the flow path accommodation space 13*d* and the flow path distribution portion 51.

Meanwhile, as to be described later, the second discharge space 10*b*2 of FIG. 2 may communicate with the flow path accommodation space 13*d* to bypass a refrigerant to the suction space 10*a* through the variable-capacity member 50.

The partition protrusion 41*c* may be disposed only on the fixed end plate 41, but in some cases, may also be disposed on a front surface of the rear housing 13 facing the fixed end plate 41.

For example, a first partition protrusion 41*c* (also, denoted by the reference numeral of the partition protrusion for the sake of explanation) may be disposed on a rear surface of the fixed end plate 41, and in correspondence with this, a second partition protrusion 13*c* may be disposed on the front surface of the rear housing 13.

The bypass guide groove 41*c*-1 is disposed inside the partition protrusion 41*c*. The bypass guide groove 41*c*-1 is disposed in an approximately V shape to accommodate second bypass holes 412*b* in both the compression chambers V together. When the partition protrusion is divided into the first partition protrusion 41*c* and the second partition protrusion 13*c*, the bypass guide groove 41*c*-1 may be disposed in both or any one of the first partition protrusion 41*c* and the second partition protrusion 13*c*.

FIGS. 2 and 3 illustrate an example in which the bypass guide groove 41*c*-1 is disposed in the first partition protrusion 41*c*. The inlet hole 41*c*-2 may be disposed in the bypass guide groove 41*c*-1.

The rotary shaft 20 is rotated by generated power and transmits force of the rotation to the orbiting scroll 30 to enable to orbitally rotate the rotary scroll 30.

As an example, the rotary shaft 20 is rotated by power transmitted through a clutch assembly 2 and may transmit force of the rotation to the orbiting scroll 30.

The rotary shaft 20 is installed to be rotatable on an inner circumference of the front housing 12. In addition, the rotary shaft 20 is installed on the shaft coupling portion 33 of the orbiting scroll 30 to orbitally rotate the orbiting scroll 30.

Desirably, the rotary shaft 20 may be disposed concentrically to the front housing 12.

The rotary shaft 20 may be supported by first and second bearings 85 and 86 to be described later.

The eccentric bush 25 may be installed on the rotary shaft 20 to enable the rotary scroll 30 to perform an orbiting motion. To do so, a coupling pin 22 to which the eccentric bush 25 is coupled may be located in an end portion of the rotary shaft 20 facing the orbiting scroll 30.

A coupling hole into which the coupling pin 22 is inserted is disposed in the eccentric bush 25 eccentrically to a center of the eccentric bush 25.

The coupling pin 22 is located at a rear end (an upper part in FIG. 2) of the rotary shaft 20 to be eccentric to a center of the rotary shaft 20. Additionally, the eccentric bushing 25 is rotatably installed on the coupling pin 22.

Additionally, a sub-balance weight 25*a* configured to help orbital rotation of the orbiting scroll 30 may be equipped with the eccentric bushing 25. The sub-balance weight 25*a* may be placed on an outer circumference of the shaft coupling portion 33 of the orbiting scroll 30.

FIG. 2 shows an example in which the sub-balance weight 25*a* is disposed integrally with the eccentric bush 25. However, the present disclosure is not limited thereto, and the sub-balance weight 25*a* may be coupled to the eccentric bush 25 as a separate member using a method such as bolting or the like.

FIG. 2 shows an example in which the orbiting scroll 30 is configured such that the eccentric bushing 25 of the rotary shaft 20 is coupled to inside of the shaft coupling portion 33 and the sub-balance weight 25*a* is disposed on an outer circumference of the shaft coupling portion 33.

Accordingly, the rotary shaft 20 is rotated by rotation force transmitted from the clutch assembly 2, and the eccentric bush 25 at an end of the rotary shaft 20 rotates eccentrically to allow the orbiting scroll 30 to orbitally rotate.

FIG. 3 is a sectional view illustrating an upper portion of FIG. 2. FIG. 4 is an enlarged sectional view illustrating a portion in which the variable-capacity member 50 of FIG. 3 is installed. FIG. 5 is an exploded perspective view illustrating a part of the scroll compressor 100 according to the present disclosure.

Figure 8:
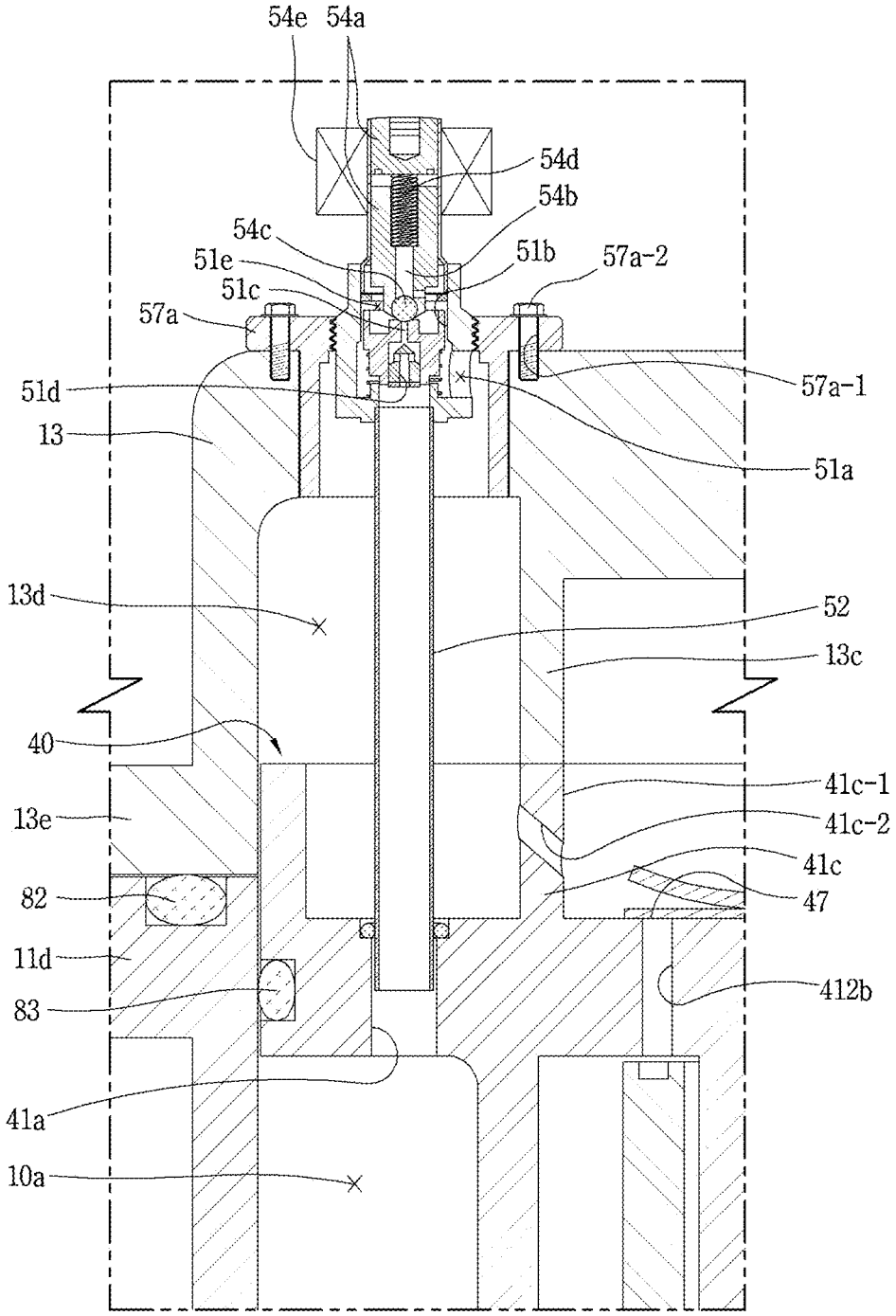
FIG. 8 is a sectional view illustrating an example in which a coupling member of the variable-capacity member is a mounting part fastened by a bolt.
Figure 9:
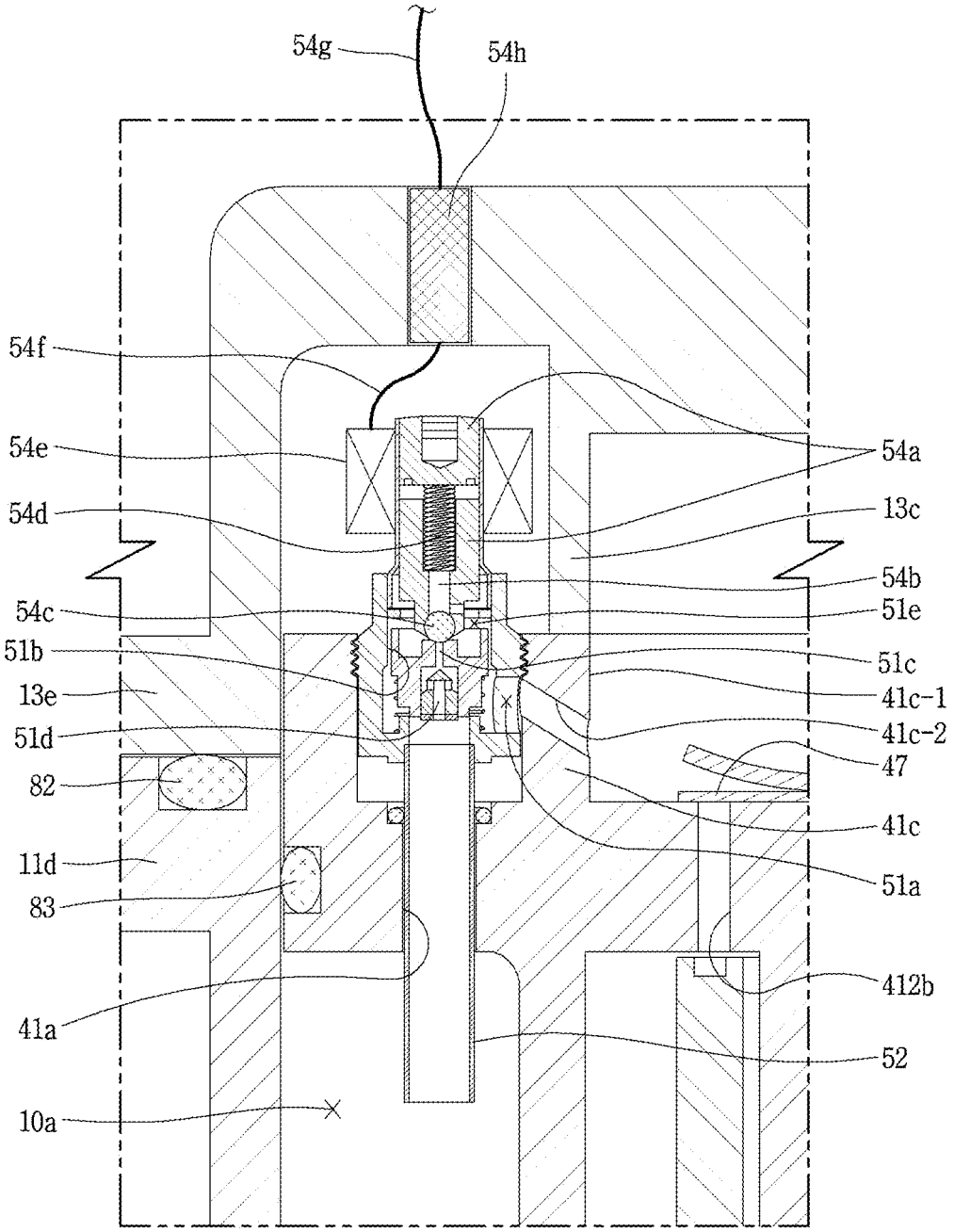
FIG. 9 is a sectional view illustrating an example in which the variable-capacity member is installed inside a rear housing.

In addition, FIG. 6 is a sectional view illustrating an example in which the flow path distribution portion 51 is closed by a valve portion 54 of the variable-capacity member 50. FIG. 7 is a sectional view illustrating an example in which the flow path distribution portion 51 is opened by the valve portion 54 of the variable-capacity member 50. FIG. 8 is a sectional view illustrating an example in which a coupling portion of the variable-capacity member 50 is a mounting part fastened by a bolt. In addition, FIG. 9 is a sectional view illustrating an example in which variable-capacity member 50 is installed inside the rear housing 13.

Hereinafter, referring to FIGS. 3 to 7, the variable-capacity member 50 in the present disclosure and a structure in which the variable-capacity member 50 is installed are described.

The flow path accommodation space 13*d* is disposed inside the housing 10.

For example, the flow path accommodation space 13*d* may be disposed between one side end of the fixed scroll 40 and an inner space of the rear housing 13.

Referring to FIGS. 3 and 4, an example in which the flow path accommodation space 13*d* is disposed in a space between an upper end of the fixed scroll 40 and a lower end of the rear housing 13 with reference to the drawings is shown.

The flow path accommodation space 13*d* is a space in which a flow path via which a refrigerant flows from the intermediate pressure chamber into a valve is disposed, and at the same time, the communication tube 52 via which the refrigerant flows back into the suction space 10*a* in the housing when the valve is opened is disposed.

As described above, the variable-capacity member 50 is installed in the housing 10 to allow some of a refrigerant compressed in a compression chamber to be bypassed to the suction space 10*a*.

As an example, in the scroll compressor 100 in the present disclosure, the variable-capacity member 50 may be coupled through the rear housing 13 as shown in FIG. 4.

The variable-capacity member 50 enables to vary a capacity by providing a refrigerant bypassed from the intermediate pressure chamber to be under a suction pressure.

In detail, in a closed state, the variable-capacity member 50 allows a refrigerant bypassed from an intermediate pressure to be accommodated in the flow path accommodation space 13*d* and the variable-capacity member 50, and in an open state, allows a refrigerant under an intermediate pressure to be provided to the suction space through the communication tube 52.

As described above, since the bypass guide groove 41c-1 may be disposed in the partition protrusion 41c and the inlet hole 41c-2 may be disposed in the bypass guide groove 41c-1, a structure in which a refrigerant under an intermediate pressure flows into the inlet portion 51a of the flow path distribution portion 51 along an inner circumference of the coupling member 57 via the inlet hole 41c-2 in the bypass guide groove 41c-1 through the bypass hole 412b may be configured, as shown in FIGS. 6 and 7.

The variable-capacity member 50 may include the flow path distribution portion 51 being in communication between a flow path inlet space and the suction space 10a and configured to accommodate a refrigerant under an intermediate pressure and then supply the accommodated refrigerant to the suction space 10a; and the valve portion 54 coupled to the flow path distribution portion 51 to open or close the flow path distribution portion 51 and configured to allow a refrigerant to be supplied to the suction space 10a.

The valve portion 54 may be, as an example, a solenoid valve.

FIGS. 3 and 4 illustrate an example in which the valve portion 54 is configured as a solenoid valve. The valve portion 54 may include cylinders 54a, a piston 54b installed to be movable relative to the cylinders 54a, a ball 54c installed at one end of the piston 54b, an elastic member 54d installed in the cylinders 54a to accommodate the piston 54b therein, and a coil 54e installed on an outer circumference of the cylinders 54a.

As to be described later, in the valve portion 54, when a current is not supplied to the coil 54e, the piston 54b is in a state of being moved downward by the elastic member 54d. Thus, since the ball 54c is in contact with an upper end of the flow path distribution portion 51, the flow path distribution portion 51 is closed.

In this state, since the communication tube 52 is closed, a refrigerant under an intermediate pressure cannot move through suction.

On the other hand, when current is supplied to the coil 54e, a relative distance between two cylinders 54a is decreased, the piston 54b moves upward, and the ball 54c becomes apart from an upper end of the flow path distribution portion 51.

In this state, the intermediate pressure refrigerant may flow into the suction space 10a through the communication tube 52 which is opened.

The flow path distribution portion 51 may include the inlet portion 51a, an inlet flow path 51b, a blocking portion 51c, and the outlet flow path 51d.

A screw thread may be disposed to protrude from an outer circumference of the flow path distribution portion 51 to be screwed to a screw thread on an inner circumference of the coupling member 57 to be described later.

The inlet portion 51a is disposed to be capable of communicating with the flow path accommodation space 13d, and may allow a refrigerant supplied from the flow path accommodation space 13d to flow into the flow path distribution portion 51 to be provided to the inlet flow path 51b.

As shown in FIG. 4, the inlet portion 51a may communicate with the flow path accommodation space 13d and be implemented to be open in a lower portion of the flow path distribution portion 51. However, the present disclosure is limited thereto, and the inlet portion 51a may be configured to have a structure of being connected to a pipe, etc. in the lower portion of the flow path distribution portion 51.

The inlet flow path 51b may be disposed between the inlet portion 51a and the blocking portion 51c so that a refrigerant provided from the inlet portion 51a flow therein.

In addition, the flow path distribution portion 51 may further include an inlet accommodating portion 51e configured to accommodate a flow path introduced between the inlet flow path 51b and the blocking portion 51c.

The blocking portion 51c is a portion with which the ball 54c may be in contact. When the ball 54c is in contact with the blocking portion 51c, a valve is closed, and when the ball 54c is separate from the blocking portion 51, the valve is opened.

The blocking portion 51c may include a configuration such as a gasket or an O-ring to seal a space between the ball 54c and the blocking portion 51c.

The outlet flow path 51d may be disposed between the blocking portion 51c and the communication tube 52, and may be a passage through which an intermediate pressure refrigerant may flow according to opening of the valve portion 54.

In addition, the communication tube 52 may be equipped at one end of the flow path distribution portion 51. The communication tube 52 may be configured, for example, as a tube, a pipe, or the like.

The communication tube 52 may be disposed to communicate with the suction space 10a in the flow path accommodation space 13d. Thus, as shown in FIG. 7, when current is applied to the coil 54e of the valve portion 54 to open the blocking portion 51c, the intermediate pressure refrigerant may be provided into the suction space 10a through the communication tube 52.

Referring to FIG. 4, the inlet portion 51a disposed in an open shape in a lower portion of the flow path distribution portion 51, the inlet flow path 51b disposed upward from the inlet portion 51a, and the inlet accommodating portion 51e in communication with the inlet flow path 51b are illustrated. In addition, an example in which the ball 54c of the valve portion 54 is in contact with an inner upper side of the flow path distribution portion 51 to define the blocking portion 51c is illustrated.

In addition, FIG. 4 illustrates an example of the outlet flow path 51d disposed downwardly to communicate with the blocking portion 51c and the communication tube 52 inserted and installed into a lower end of the flow distribution portion 51 to communicate with the outlet flow path 51d.

Meanwhile, the communication tube 52 may have one end coupled to the fixed scroll 40 to be capable of communicating with the suction space 10a.

To do so, the fixed scroll 40 may be equipped with a communication hole 41a, and an O-ring for sealing may be installed in the communication hole 41a.

In addition, the flow path accommodation space 13d is defined by one side of the fixed scroll 40 and an inner side of the housing 10, the one side being opposite to another side of the fixed scroll 40 toward which the orbiting scroll is disposed. The suction space 10a may be disposed between the compression part and the housing 10. Meanwhile, the communication hole 41a into which one end of the communication tube 52 is inserted is disposed in the fixed scroll 40. As shown in FIG. 4, the communication hole 41a communicates between the flow path accommodation space 13d and the suction space 10a.

As described above, the valve portion 54 may be coupled to one side of the flow path distribution portion 51.

As shown in FIGS. 4 and 6, the cylinder 54a may be configured as two members, and when current is supplied to the coil 54e, the two cylinders 54a may move relative to each other.

Among the two cylinders, one cylinder 54*a* positioned in an upper portion may be fixedly coupled to the coil 54*e*, and when current is supplied to the coil 54*e*, another cylinder 54*a* positioned in a lower portion may move relative to the coil 54*e* to cause the ball 54*c* to be separate from the blocking portion 51*c*. That is, the one cylinder 54*a* positioned in the upper portion may be understood as a fixed core, and the another cylinder 54*a* positioned in the lower portion may be understood as a movable core.

Meanwhile, as shown in FIG. 6, when current is not supplied to the coil 54*e*, the piston 54*b* is pressed by the elastic member 54*d* to cause the ball 54*c* to come into contact with the blocking portion 51*c* so that the flow path distribution portion 51 is closed by a valve. As shown in FIG. 7, when current is supplied to the coil 54*e*, a relative distance between the two cylinders 54*a* is reduced and the elastic member 54*d* is compressed. Then, the ball 54*c* is separated from the blocking portion 51*c* and the flow path distribution portion 51 is opened by the valve to cause a refrigerant to flow into the suction space 10*a*.

Meanwhile, the variable-capacity member 50 may further include the coupling member 57 coupled to the housing 10.

As shown in FIG. 6, the coupling member 57 is coupled to a side portion of the flow path distribution portion 51, and may be coupled to one side of the housing 10 to allow the flow path distribution portion 51 to be fixed to the one side of the housing 10.

A screw thread may be disposed on an inner circumferential surface of the coupling member 57 to be screwed to a screw thread on an outer circumferential surface of the flow path distribution portion 51. The screw thread may be disposed to protrude on the outer circumference of the flow path distribution portion 51.

The coupling member 57 includes a flange portion 57*a*, and the flange portion 57*a* is located on an outer circumference of the housing 10 to protrude from an outer circumference of the connecting member 57.

The coupling member 57 may be screwed to the housing 10. To do so, the housing 10 may be equipped with a coupling hole, and a screw thread is disposed on an inner circumference of the coupling hole. The coupling member 57 has a screw thread disposed on an outer circumference to be screwed to the screw thread on the inner circumference of the coupling hole.

As such, the coupling member 57 may be a "connector part" with a structure having a screw thread disposed on an outer circumference to be screwed to the housing 10.

However, the coupling member 57 is not necessarily limited thereto, and may be a "mounting part" coupled to the housing 10 by bolting (FIG. 8).

First, referring to FIGS. 4, 6, and 7, etc., a description will be given of a case in which the coupling member 57 is a connector part screwed and inserted into the housing 10.

The coupling member 57 enables the flow path distribution portion 51 to be coupled to the housing 10. As an example, the coupling member 57 may enable the flow path distribution portion 51 to be coupled to the rear housing 13.

In addition, the coupling member 57 may have a space capable of accommodating the flow distribution portion 51 therein, and a flow path capable of communicating with the inlet portion 51*a*.

As an example, the coupling member 57 may have an inner screw portion in an upper portion to be screwed to an outer circumference of the flow path distribution portion 51 and disposed inside. To do so, a screw thread may be disposed on the outer circumference of the flow path distribution portion 51 to be capable of being screwed to the inner screw portion of the coupling member 57.

Additionally, the coupling member 57 may have an outer screw portion disposed in a lower portion and screwed to a coupling portion of the rear housing 13. The coupling portion of the rear housing 13 may have a screw thread disposed to be screwed to the outer screw portion of the coupling member 57.

In addition, the coupling member 57 may be configured to have one open end, and include an accommodating space capable of receiving and providing an intermediate pressure refrigerant to the inlet portion 51*a* of the flow path distribution portion 51.

The coupling member 57 may be configured to have a cylindrical shape on a whole, with one end having a shape of a flange. In addition, the flange may include a hexagonal section to configure a structure capable of easily receiving a torque using a coupling tool, etc. Thus, the coupling member 57 may be easily screwed to the coupling portion of the rear housing 13.

As such, the coupling member 57 coupled to the housing 10 using a screw is screwed to the outer circumference of the flow path distribution portion 51, and screwed to an inner circumference of the coupling portion of the rear housing 13, thereby allowing the variable-capacity member 50 to be connected to the rear housing 13. In addition, the coupling member 57 has an accommodating space therein to accommodate and provide an intermediate pressure refrigerant to the inlet portion 51*a* of the flow path distribution portion 51.

FIG. 8 illustrates an example in which the coupling member 57 of the variable-capacity member 50 is implemented as a "mounting part" fastened by a bolt 57*a*-2.

Hereinafter, referring to FIG. 8, a description will be given of a case in which the coupling member 57 is fastened to the housing 10 using the bolt 57*a*-2.

The coupling member 57 allows the flow path distribution portion 51 to be coupled to the housing 10. As an example, the coupling member 57 may allow the flow path distribution portion 51 to be coupled to the rear housing 13.

In addition, the coupling member 57 may have a space capable of accommodating the flow distribution portion 51 therein, and a flow path capable of communicating with the inlet portion 51*a*.

As an example, the coupling member 57 may have an inner screw portion in an upper portion to be screwed to an outer circumference of the flow path distribution portion 51 and disposed inside. To do so, a screw thread may be disposed on the outer circumference of the flow path distribution portion 51 to be capable of being screwed to the inner screw portion of the coupling member 57.

In addition, the coupling member 57 may have the flange portion 57*a* disposed on an upper portion, and the flange portion 57*a* may be equipped with a bolt coupling hole 57*a*-1 capable of being coupled by the rear housing 13 and the bolt 57*a*-2. The bolt 57*a*-2 installed in the bolt coupling hole 57*a*-1 of the coupling member 57 may be coupled onto an upper surface of the rear housing 13. Thus, the coupling member 57 may be bolted to the rear housing 13, and the variable-capacity member 50 may be coupled to an upper portion of the rear housing 13.

To do so, a bolt hole in communication the bolt coupling hole 57*a*-1 may be disposed in one surface of the housing 10, and a bolt may be fastened into the bolt coupling hole 57*a*-1 and the bolt hole so that the coupling member 57 may be bolted to one surface of the housing 10.

As an example, the coupling member 57 may be bolted onto one surface of the rear housing 13, and to do so, the bolt hole may be disposed in the rear housing 13.

In addition, the coupling member 57 may be configured to have one open end, and provided with an accommodating space therein to be capable of receiving and providing an intermediate pressure refrigerant to the inlet portion 51*a* of the flow path distribution portion 51.

The coupling member 57 may be configured to have a cylindrical shape on a whole.

As such, the coupling member 57 may be screwed to an outer circumference of the flow path distribution portion 51 and coupled to an upper surface of the rear housing 13 by a bolt, thereby allowing the variable-capacity member 50 to be coupled to the rear housing 13. In addition, the coupling member 57 has an accommodating space therein to accommodate and provide an intermediate pressure refrigerant to the inlet portion 51*a* of the flow path distribution portion 51.

Meanwhile, as shown in FIG. 9, the flow path distribution portion 51 and the valve portion 54 may be placed inside the housing 10.

Referring to FIG. 9, an example of installation in which a core of the valve portion 54 is connected to a first coil wire 54*f* and electrically connected to a coil wire 54*g* connected to an external power source through a connector 54*h* coupled into an upper surface of the rear housing 13 to supply power is illustrated.

The fixed scroll 40 has a flow path distribution accommodating portion disposed concavely on one surface, opposite to a side in which the compression chamber is disposed, such that the flow path distribution portion 51 is inserted into the one surface. The flow path distribution portion 51 may be coupled to the flow path distribution accommodating portion.

Thus, the flow path distribution portion 51 and the valve portion 54 may be arranged inside the housing 10, and the flow path distribution portion 51 is coupled to the flow path distribution accommodating portion. Accordingly, the compressor may have a simple structure.

As shown in FIG. 9, the flow path distribution portion 51 may have a screw thread disposed on an outer circumference, the flow path distribution accommodating portion may have a screw thread disposed on an inner circumference. The flow path distribution portion 51 may be screwed to the flow path distribution accommodating portion.

By doing so, the flow path distribution portion 51 and the valve portion 54 may be arranged inside the housing 10, and the flow path distribution portion 51 is coupled to the flow path distribution accommodating portion by screwing. Accordingly, the compressor may have a simple structure.

Referring to FIG. 9, an example in which the flow path distribution accommodating portion is disposed in an upper portion of the fixed scroll 40, and the flow path distribution portion 51 is screwed to the flow path distribution accommodating portion is shown.

The flow path distribution portion 51 may include the inlet portion 51*a* having one open side into which an intermediate pressure refrigerant in the compression chamber may be received and introduced, the inlet flow path 51*b* which may communicate with the inlet portion 51*a* and into which the refrigerant provided from the inlet portion 51*a* may flow; the outlet flow path 51*d* which communicates with the inlet flow path 51*b* and through which the flowing refrigerant may flow out into the suction space 10*a*; and the blocking portion 51*c* which is placed between the inlet flow path 51*b* and the outlet flow path 51*d* and may be opened or closed by the valve portion 54.

A detailed configuration of the flow path distribution portion 51 is described above. Thus, a detailed description thereof will be not be provided here again.

According to this structure, some of refrigerant compressed in the compression chamber may be received through the inlet portion 51*a* of the flow path distribution portion 51, and flow into the suction space 10*a* through the inlet flow path 51*b*, the outlet flow path 51*d*, and the communication tube 52, and the valve portion 54 may cause a part of the flow path distribution portion 51 to be opened or closed. Thus, some of the refrigerant compressed in the compression part may be bypassed inside the housing 10 to thereby achieve capacity variation while a configuration of the compressor may be simplified without components such as external valves, ports, etc.

In the flow path distribution portion 51, the communication tube 52 in communication between the outlet flow path 51*d* and the suction space 10*a* may be coupled to one end of the flow path distribution portion 51 connected to the outlet flow path 51*d*.

The bypass guide groove 41*c*-1 in communication with the intermediate pressure chamber of the compression chamber and defined by inside of the housing 10 may be disposed in one surface of the fixed scroll 40, and the inlet hole 41*c*-2 in communication between the inlet portion 51*a* and the bypass guide groove 41*c*-1 may be disposed in the flow distribution accommodating portion.

According to this structure, some of a refrigerant in the compression chamber may be bypassed to the suction space 10*a* directly through the flow path distribution portion 51 via the bypass guide groove 41*c*-1 and the inlet hole 41*c*-2.

Meanwhile, the rear housing 13 is configured such that one end (a front end, i.e., a lower end with reference to FIG. 2) is open and another end (a rear end, i.e., an upper end with reference to FIG. 2) has a closed and approximately cylindrical shape.

In the present disclosure, it may be understood that a front side is a side in which the front housing 12 is located, and a rear side is a side in which the rear housing 13 is located, as indicated in names of the front housing 12 and the rear housing 13. However, in the present disclosure, for convenience in the drawing, a description may be provided with reference to upper and lower directions in the drawing (i.e., with reference to FIG. 2, the rear housing 13 is in an upper side and the front housing is in a lower side).

In other words, the front end facing the fixed scroll 40 is configured to have an open shape, and the rear end facing away from the fixed scroll 40 is configured to have a closed shape.

Accordingly, an inner space of the rear housing 13 defines the discharge space 10*b* together with a rear surface of the fixed end plate 41, which will be described later, so as to accommodate a refrigerant discharged from the compression chamber V.

A rear flange portion 13*e* fastened by bolts to a middle flange portion 11*d* extends from the front end of the rear housing 13 to have a flange shape. The rear flange portion 13*e* has a second sealing member 82 inserted between the middle flange portion 11*d* and the rear flange portion 13*e* to be bolted along a circumferential direction.

A third connection protrusion (no reference numeral) and a fourth connection protrusion (no reference numeral) are disposed on the rear end of the rear housing 13 having a closed shape. The third connection protrusion is disposed at a center of the rear end of the rear housing 13, and the fourth connection protrusion is disposed near the third connection protrusion. The refrigerant discharge port 13*a* is disposed on the third connection protrusion, and a bypass port 13*b* is disposed on the fourth connection protrusion. The refrigerant discharge port 13*a* and the bypass port 13*b* are disposed through a space between inner and outer surfaces of the rear housing 13.

The front housing 12 orbitally supports the orbiting scroll 30.

As an example, the front housing 12 may support a second surface in which the ring accommodating groove 31*a* of the orbiting scroll 30 is disposed.

The front housing 12 may be positioned between the clutch assembly 2 and the orbiting scroll 30.

The front housing 12 may be made of a cast iron material. Since the front housing 12 is made of a cast iron material, when the scroll compressor 100 in the present disclosure is applied to a commercial heat pump, a load is great and movement of the compressor is not needed compared to a case when applied to a vehicle's air conditioning compressor. Thus, reliability may be secured.

Meanwhile, the front housing 12 may be made of a material such as aluminum or cast iron to reduce a weight of the compressor when applied to a vehicle.

Meanwhile, the front housing 12 may be coupled to a front end of the middle housing 11 to seal the suction space 10*a*, i.e., an inner space of the middle housing 11, while supporting the orbiting scroll 30 in an axial direction. As such, the front housing 12 may constitute a part of the housing 10 while performing a function as a frame constituting a compression part.

Hereinafter, a detailed configuration of the front housing 12 is described.

The front housing 12 may include a flange portion 12*a* of the housing 10, and a support wall portion 12*b*.

The flange portion 12*a* of the housing 10 is placed to have one surface facing the clutch assembly 2 and another surface facing the orbiting scroll 30.

In addition, since the flange portion 12*a* of the housing 10 may be coupled to the middle flange portion 11*d* of the middle housing 11, the front housing 12 is fixedly supported by the middle housing 11 to orbitally support the orbiting scroll 30.

In addition, as described above, the flange portion 12*a* of the housing 10 may constitute a part of an outer appearance of the compressor to perform a function as a part of the housing 10.

In addition, the flange portion 12*a* of the housing 10 has a flange shape extending radially from an outer circumference of the front housing 12. As an example, the flange portion 12*a* of the housing 10 may have a circular section, and in this case, the flange portion 12*a* of the housing 10 has a disk shape.

Additionally, the front housing 12 may be provided with shaft coupling portions 12*d* and 12*f*. A first shaft coupling portion 12*d* may be disposed at a front end (a lower part with reference to FIG. 2) of the front housing 12. The rotary shaft 20 may be installed in the first shaft coupling portion 12*d*.

The shaft coupling portions 12*d* and 12*f* may include the first shaft coupling portion 12*d* with a small inner diameter at a front side and a second shaft coupling portion 12*f* with a large inner diameter at a rear side.

The first shaft coupling portion 12*d* may be configured to have a small inner diameter, and a second shaft coupling portion 12*f* may be configured to have a large inner diameter.

Referring back to FIG. 2, an example in which the support wall portion 12*b* of the front housing 12 includes the first and second shaft coupling portions 12*d* and 12*f* is shown.

Additionally, the first and second bearings 85 and 86 may be installed in the first and second shaft coupling portions 12*d* and 12*f*.

As shown in FIG. 2, the first and second bearings 85 and 86 may be ball bearings, but are not necessarily limited thereto. The first and second bearings 85 and 86 may be needle bearings or bushing bearings.

In addition, the orbiting scroll 30 is arranged to be adjacent to the second bearing 86. As vibration according to rotation of the orbiting scroll 30 is transmitted, the second bearing 86 may be configured as a bearing having a greater load bearing capacity than that of the first bearing 85.

As shown in FIG. 2, a lower part (a front side) of the rotary shaft 20 is supported by the first bearing 85, and an upper part of the rotary shaft 20 is supported by the second bearing 86.

Meanwhile, a mechanical seal 84 may be installed on the rotary shaft 20 between the first and second bearings 85 and 86 in an axial direction. The mechanical seal 84 may be installed between the rotary shaft 20 and an inner circumference of the front housing 12, and seal a front side of the suction space 10*a*.

The mechanical seal 84 may include a fixed sealing body 84*b* and a rotary sealing body 84*a*.

The fixed sealing body 84*b* may be fixedly coupled to an inner circumference surface of the shaft coupling portion 12*d* disposed on a front side of the front housing 12, and the rotary sealing body 84*a* may be coupled to an outer circumference surface of the rotary shaft 20 to rotate together with the rotary shaft 20 in a lubricating space 12*d*-1.

Accordingly, since the rotary sealing body 84*a* is brought into close contact with the fixed sealing portion 84*b* during rotation of the rotary shaft 20, a space between the shaft accommodating portion 12*e* and the lubrication space 12*d*-1 each disposed on a front side of the front housing 12, i.e., a front side of the suction space 10*a* is sealed.

The support wall portion 12*b* may be disposed on a surface of the flange portion 12*a* of the housing 10 facing the orbiting scroll 30.

The support wall portion 12*b* may be disposed to protrude on the surface of the flange portion 12*a* of the housing 10 facing the orbiting scroll 30.

Additionally, the support wall portion 12*b* may be configured to have a cylindrical structure with both open ends.

The rotary shaft 20 configured to transmit rotational force to the orbiting scroll 30 may be accommodated inside the support wall portion 12*b*.

In addition, an orbiting space 12*b*-1 is disposed on an inner circumference of the support wall portion 12*b*. The orbiting space 12*b*-1 is a space in which the coupling portion 33 of the orbiting scroll 30 performs an orbiting motion, and may be configured to communicate with an inner space of the shaft accommodating portion, etc.

A diameter of an outer circumference of the support wall portion 12*b* needs be configured to be greater than a diameter of the orbiting end plate 31. In addition, the support wall portion 12*b* may desirably have a predetermined width to maintain sufficient rigidity to orbitally support the orbiting scroll 30.

The support wall portion 12*b* may be positioned radially within a certain distance from an outer circumference of the flange portion 12*a* of the housing 10.

Additionally, an outer circumferential surface of the support wall portion 12*b* is in close contact with an inner circumferential surface of the middle housing 11. Accordingly, the flange portion 12*a* of the housing 10 may be fixed to an inner side of the middle housing 11.

The support wall portion 12*b* has an orbiting support surface 12*a*-1 that orbitally supports the orbiting scroll 30. Referring to FIGS. 2 and 5, the orbiting support surface 12*a*-1 may be disposed on an upper surface of the support wall portion 12*b*. The thrust plate 35 may be installed between the orbiting support surface 12*a*-1 and the orbiting scroll 30.

That is, a structure in which the thrust plate 35 is installed between the front housing 12 and the orbiting scroll 30 may be configured.

Thus, it may be understood that the thrust plate 35 is disposed on a "rear surface" of the support wall portion 12*b*.

Meanwhile, configurations of the anti-rotation pin 71 and an oil supply groove 12*c* may be disposed on the orbiting support surface 12*a*-1. This will be described later.

Meanwhile, as illustrated in FIG. 2, the support wall portion 12*b* may be inserted into an inner circumference of the middle housing 11. Additionally, the front housing 12 may be coupled to the middle housing 11 by shrink-fitting or welding.

Additionally, the support wall portion 12*b* may be disposed integrally with the flange portion 12*a* of the housing 10. However, the support wall portion 12*b* is not limited thereto, and may be disposed as a separate member to be coupled to the flange portion 12*a* of the housing 10 by bolts, etc. In this case, configurations such as the first and second bearings 85 and 86 and the mechanical seal 84 each described above may be easily assembled.

The anti-rotation member 70 is configured to prevent rotation of the orbiting scroll 30 while causing the orbiting scroll 30 to perform an orbiting rotation. When the anti-rotation member 70 is not present, the orbiting scroll 30 may rotate by driving force transmitted by the rotary shaft 20. That is, the anti-rotation member 70 may prevent rotation of the orbiting scroll 30, and cause the orbiting scroll 30 to perform an orbiting motion.

The anti-rotation member 70 may include the anti-rotation pin 71 and the anti-rotation ring 72. The anti-rotation pin 71 and the anti-rotation ring 72 may be each disposed in plurality. Referring to FIG. 3, as illustrated, six anti-rotation pins 71 and six anti-rotation rings 72 may be disposed. However, the anti-rotation pins 71 and the anti-rotation rings 72 are not limited thereto, and may be provided in different numbers.

Hereinafter, structures of the anti-rotation pins 71 and the anti-rotation rings 72 are described.

The orbiting support surface 12*a*-1 is equipped with the anti-rotation pins 71 disposed to protrude toward the orbiting scroll 30.

The anti-rotation pins 71 may be disposed as separate members. In this case, pin coupling holes 12*a*-2 into which the anti-rotation pins 71 are coupled may be disposed in the orbiting support surface 12*a*-1. The pin coupling holes 12*a*-2 may be disposed in plurality to be coupled to the anti-rotation pins 71. The plurality of pin coupling holes 12*a*-2 may be arranged to be spaced apart from each other along a circumferential direction.

However, the anti-rotation pins 71 are necessarily limited to a structure of being installed as separate members. The anti-rotation pins 71 may be disposed integrally with the orbiting support surface 12*a*-1.

The oil supply groove 12*c* to be described later may be located between the anti-rotation pins 71 and the orbiting support surface 12*a*-1.

Meanwhile, the anti-rotation pins 71 disposed on the orbiting support surface 12*a*-1 may be orbitally installed in the anti-rotation rings 72 coupled to the ring accommodating groove 31*a* of the orbiting scroll 30 described above. The anti-rotation rings 72 is configured to be capable of performing an orbiting motion relative to the anti-rotation pins 71.

The anti-rotation rings 72 are restrained from performing a behavior in a radial direction by the anti-rotation pins 71 to be prevented from rotating and caused to perform an orbiting motion together with the orbiting scroll 30.

The anti-rotation rings 72 are fixedly or rotatably inserted into the ring accommodating groove 31*a*. In addition, the anti-rotation pins 71 are slidably inserted into the anti-rotation rings 72 from an inner circumference of the anti-rotation rings 72 along a circumferential direction. The anti-rotation rings 72 may have a circular ring shape or a C shape with one open side. In the present disclosure, an example in which the anti-rotation rings 72 have a circular ring shape, like the ring accommodating groove 31*a*, is illustrated.

Due to a structure of the anti-rotation pins 71 and the anti-rotation rings 72, the orbiting scroll 30 may perform an orbiting motion between the front housing 12 and the fixed scroll 40.

Meanwhile, the oil supply groove 12*c* configured to allow to supply oil to a surface between the front housing 12 and the orbiting scroll 30 may be disposed in the support wall portion 12*b*.

The oil supply groove 12*c* may be disposed to be concave in the orbiting support surface 12*a*-1 of the support wall portion 12*b*.

The oil supply groove 12*c* may be disposed in the orbiting support surface 12*a*-1 in at least one of a circumferential direction and a radial direction crossing the circumferential direction.

By doing so, oil accommodated in an inner circumference of the housing 10 may flow on the orbiting support surface 12*a*-1 through the oil supply groove 12*c* in the front housing 12 according to rotation of the orbiting scroll 30, and may be supplied between the front housing 12 and the rotating scroll 30, thereby improving reliability.

The suction space 10*a* is disposed inside the housing 10, and an oil storage space 10*c* defines a lower half portion of the suction space 10*a*. Oil is may be stored in the oil storage space 10*c*, and supplied between the front housing 12 and the orbiting scroll 30 through the oil supply groove 12*c*.

Meanwhile, the oil may be supplied from an oil recovery device configured to separate oil from a refrigerant discharged from the compression chamber V and return the oil to the compressor.

As an example, the oil supply groove 12*c* may be disposed in plurality. The plurality of oil supply grooves 12*c* may be spaced apart from each other in a circumferential direction and may be disposed on the orbiting support surface 12*a*-1 to penetrate through an inner circumference and an outer circumference of the front housing 12.

The scroll compressor 100 according to the present disclosure may further include the clutch assembly 2.

The clutch assembly 2 may include a clutch plate 2*a*, a pulley 2*b*, and a coil portion 2*c*.

When power is supplied to a motor unit (not shown) disposed outside and the motor unit is driven, the clutch plate 2*a* connected to the motor unit is driven to allow operation of the clutch assembly 2 including the pulley 2*b* and the coil portion 2*c*.

The pulley 2*b* may rotate by receiving power generated from the motor unit disposed outside.

A belt or the like may be installed on the pulley 2*b* to receive power generated from outside. According to the rotation of the pulley 2*b*, the rotary shaft 20 may be rotated, thereby allowing the orbiting scroll 30 to perform an orbital motion.

As an example, as power generated from the motor unit disposed outside is transmitted by a pulley coupled to the motor unit disposed outside, the pulley 2*b* of the clutch assembly 2 may rotate. In this case, the pulley connected to the motor unit disposed outside may be understood as a drive pulley configured to directly rotate by the motor unit disposed outside, and the pulley 2*b* of the clutch assembly 2 may be understood as the pulley 2*b* of a same type connected to the drive pulley 2*b* by a belt to indirectly rotate.

Hereinafter, operation of the scroll compressor 100 according to the present disclosure is described.

That is, when operation of a gas engine heat pump in which the scroll compressor 100, a condenser, an expander, and an evaporator are configured to constitute a closed loop is selected, the clutch assembly 2 transmits driving force to the rotary shaft 20. The driving force transmitted to the rotary shaft 20 is transmitted to the orbiting scroll 30 through the rotary shaft 20.

Then, the orbiting scroll 30 performs an orbiting motion by an eccentric distance of the eccentric bush 25 in a state of being supported on the front housing 12. Together with this, two, i.e., a pair of compression chambers V each including a suction chamber, an intermediate pressure chamber, and a discharge chamber are consecutively disposed between the orbiting wrap 32 and the fixed wrap 42. The compression chambers V are decreased in volume as moving toward a center by a continuous orbiting motion of the orbiting scroll 30, and a refrigerant is compressed while moving along the compression chambers V and then discharged into the discharge space 10*b*, i.e., the first discharge space 10*b*1 of FIG. 2 through the discharge port 411.

Meanwhile, with respect to a refrigerant in the intermediate pressure chamber of the compression chamber, as the second bypass hole 412*b* is opened or closed by the second bypass valve 47, some of a refrigerant in the compression chamber, i.e., an intermediate pressure refrigerant is provided to the flow path accommodation space 13*d* through the inlet hole 41*c*-2.

The refrigerant supplied to the flow path accommodation space 13*d* passes through the inlet portion 51*a* and the inlet flow path 51*b* of the flow path distribution portion 51 via an inner circumference of the coupling member 57. In a closed state in which current is not supplied to the valve portion 54 when the refrigerant is accommodated in the inlet accommodating portion 51*e*, the refrigerant may not flow in the blocking portion 51*c*.

When current is supplied to the valve portion 54, the piston 54*b* to which the ball 54*c* is coupled may move upward, and as the blocking portion 51*c* is opened, the refrigerant may flow into the suction space 10*a* through the outlet flow path 51*d* and the communication tube 52.

Through this process, some of the refrigerant in the intermediate pressure chamber is bypassed to the suction space 10*a* to thereby enable to vary a capacity.

That is, in the scroll compressor 100 in the present disclosure, some of refrigerant being compressed is caused to flow into the suction space 10*a* to vary a capacity simply by mounting a valve without having to dispose a valve, a pipe, a separate intermediate pressure port for intermediate pressure piping, and a separate suction path for suction outside the compressor.

In addition, in the scroll compressor 100 in the present disclosure, the variable-capacity member 50 is installed in the housing 10 and a passage in communication with the variable-capacity member 50 is equipped. Thus, a refrigerant being compressed inside may communicate with suction to reduce an amount of the refrigerant to allow capacity variation.

Figure 10:
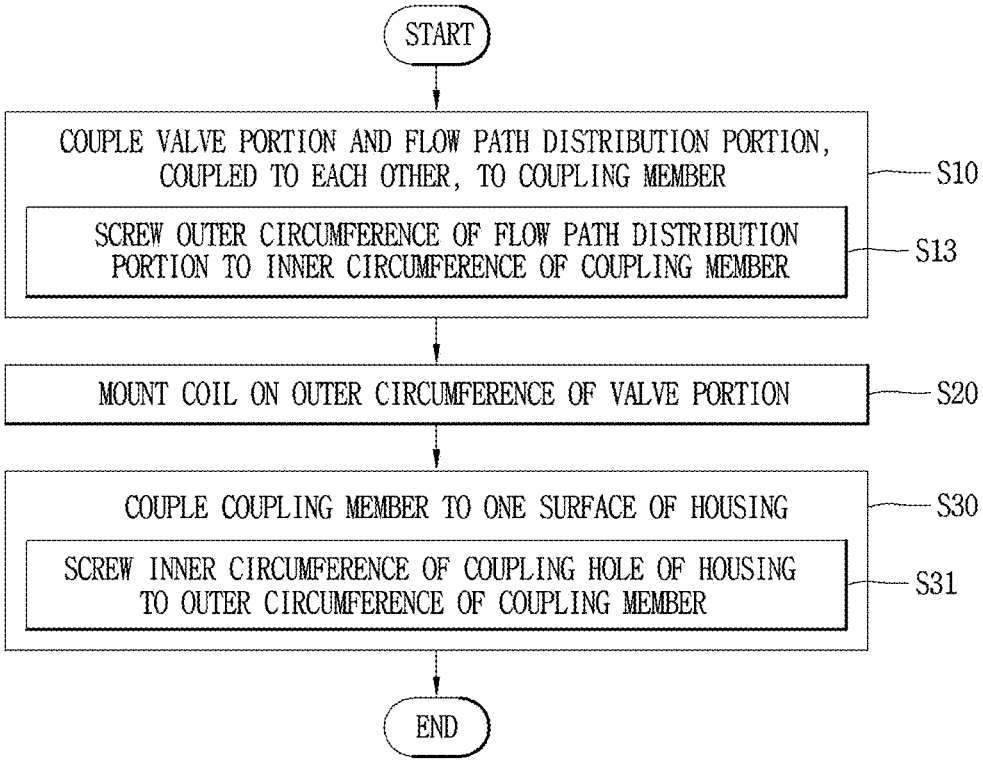
FIG. 10 is a flowchart illustrating one example of a method of assembling the variable-capacity member according to the present disclosure.
Figure 11:
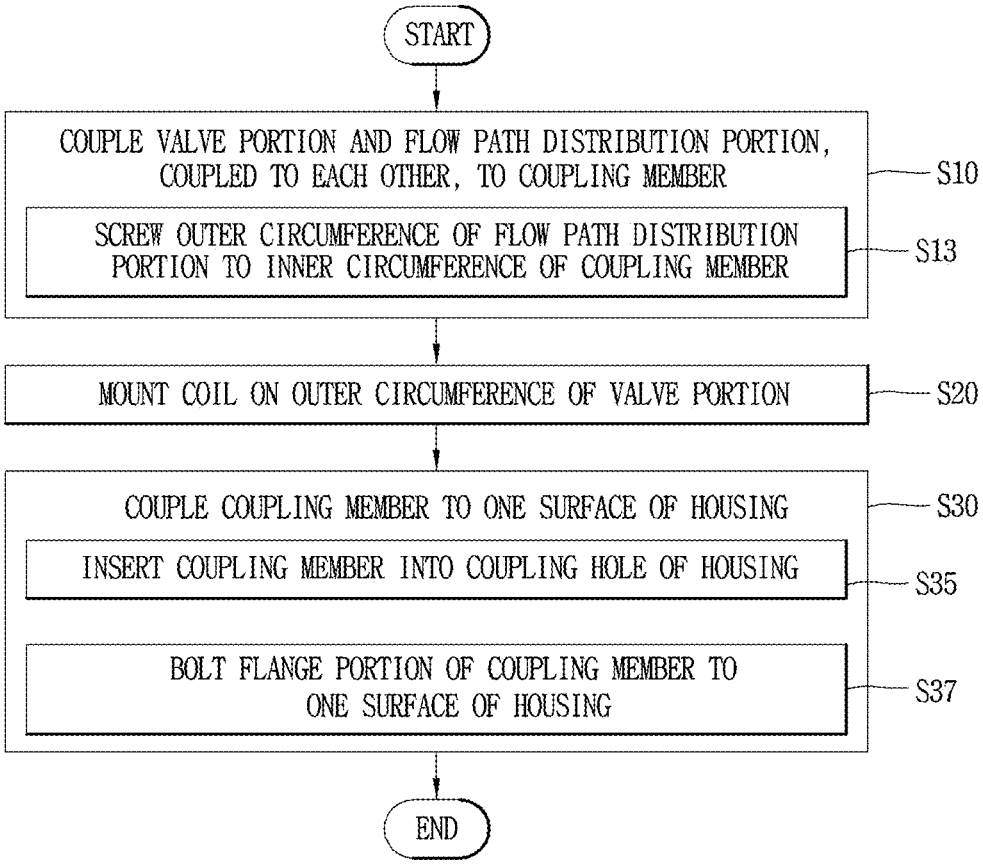
FIG. 11 is a flowchart illustrating another example of the method of assembling the variable-capacity member according to the present disclosure.

FIG. 10 is a flowchart illustrating one example of a method of assembling the variable-capacity member 50 in the present disclosure. FIG. 11 is a flowchart illustrating another example of a method of assembling the variable-capacity member 50 in the present disclosure.

Figure 12:
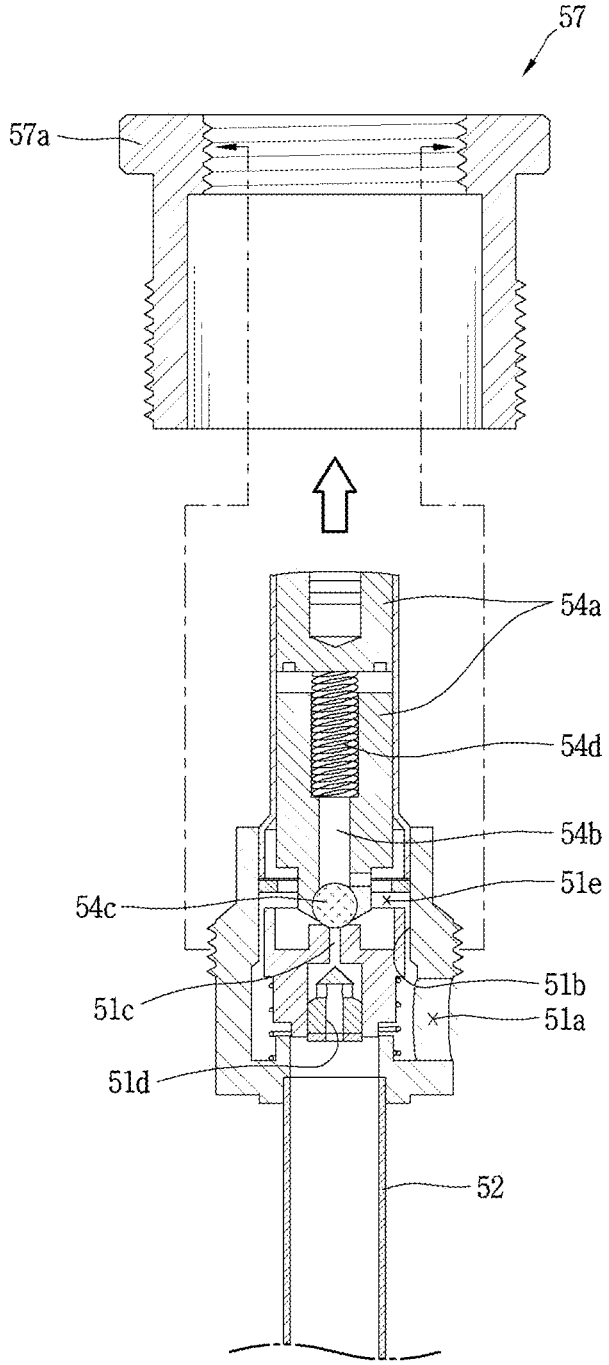
FIG. 12 is a conceptual diagram illustrating an example of assembling the valve portion and the flow path distribution portion into a connector part.
Figure 13:
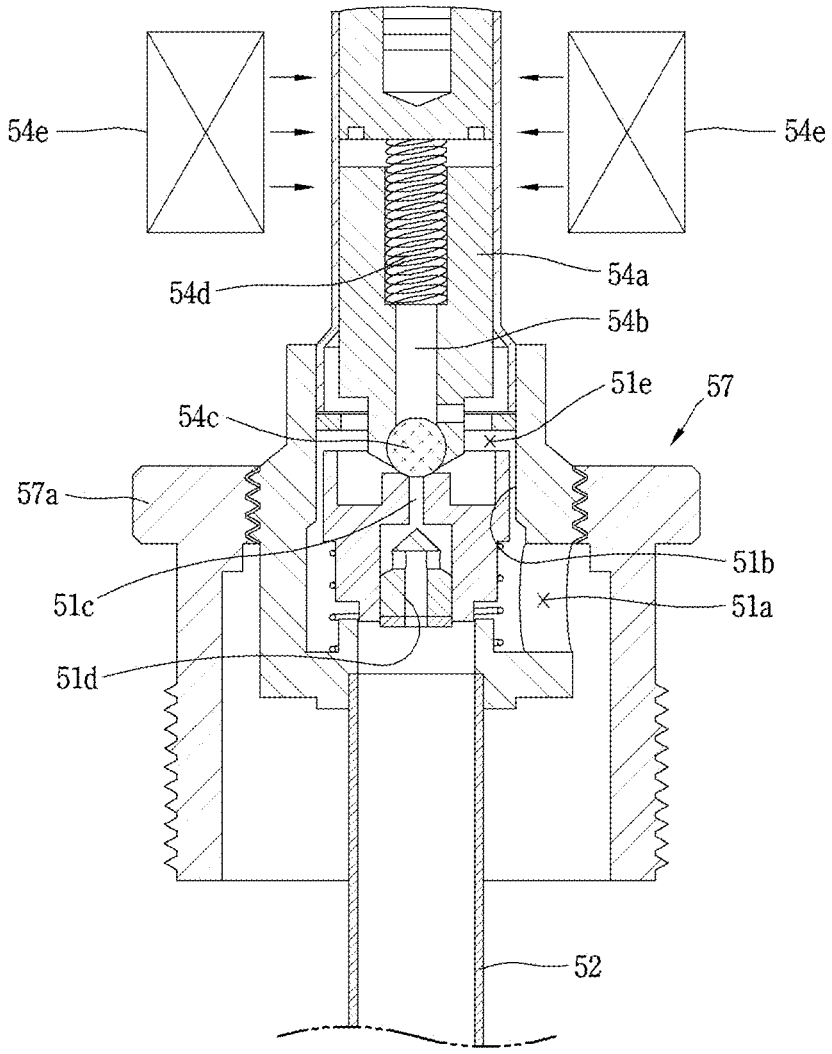
FIG. 13 is a conceptual diagram illustrating an example of mounting a coil on an outer circumference of a cylinder.
Figure 14:
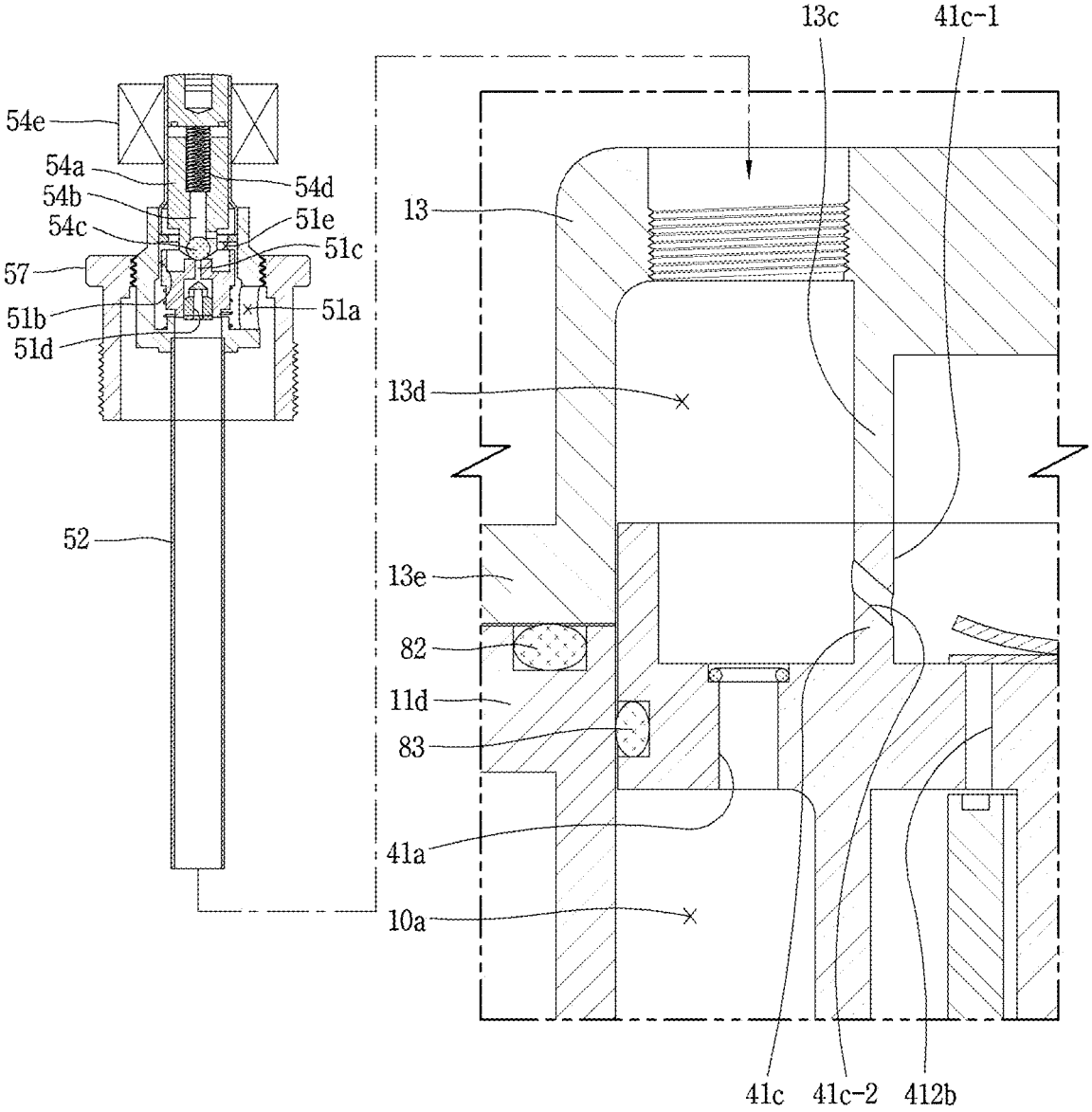
FIG. 14 is a conceptual diagram illustrating an example of assembling the variable-capacity member to the rear housing and a fixed scroll.

In addition, FIG. 12 is a conceptual diagram illustrating an example of assembling the valve portion 54 and the flow path distribution portion 51 into a connector part. FIG. 13 is a conceptual diagram illustrating an example of mounting the coil 54*e* on an outer circumference of the cylinder 54*e*. FIG. 14 is a conceptual diagram illustrating an example of assembling the variable-capacity member 50 to the rear housing 13 and the fixed scroll 40.

Figure 15:
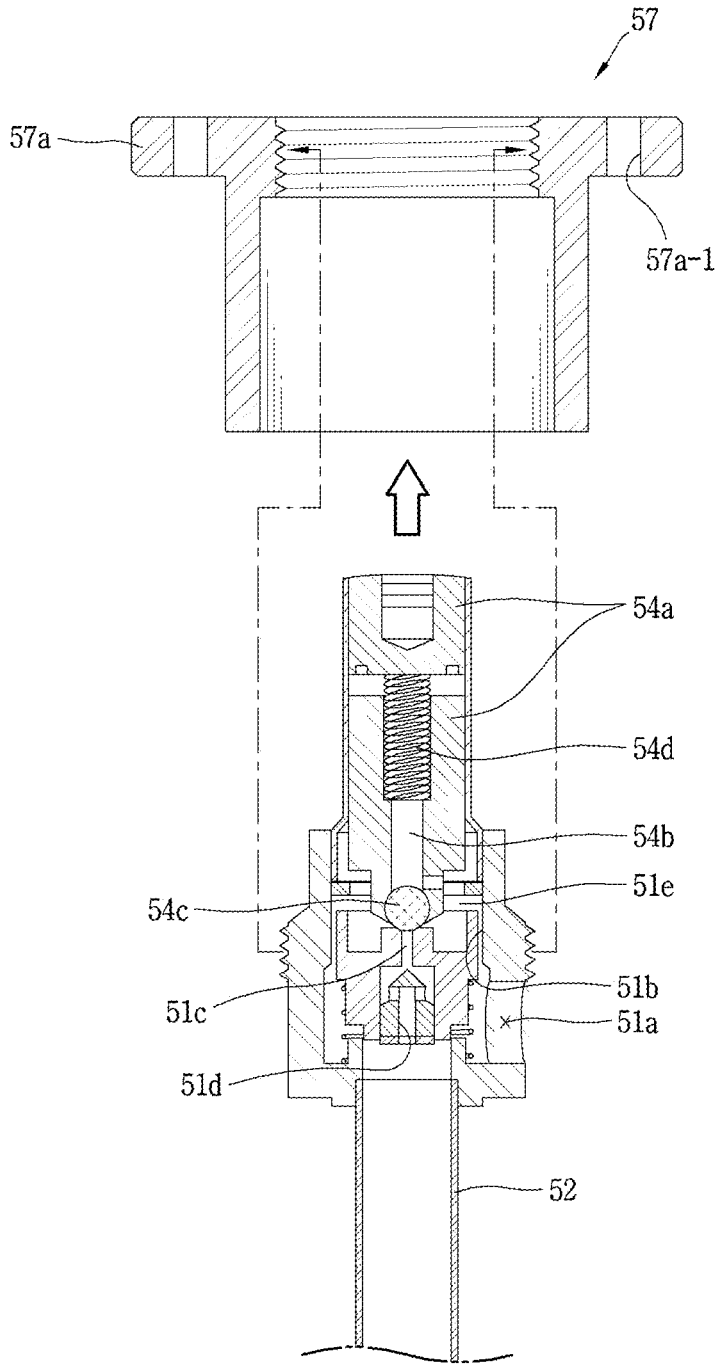
FIG. 15 is a conceptual diagram illustrating an example of assembling the valve portion and the flow path distribution portion into the mounting part.
Figure 16:
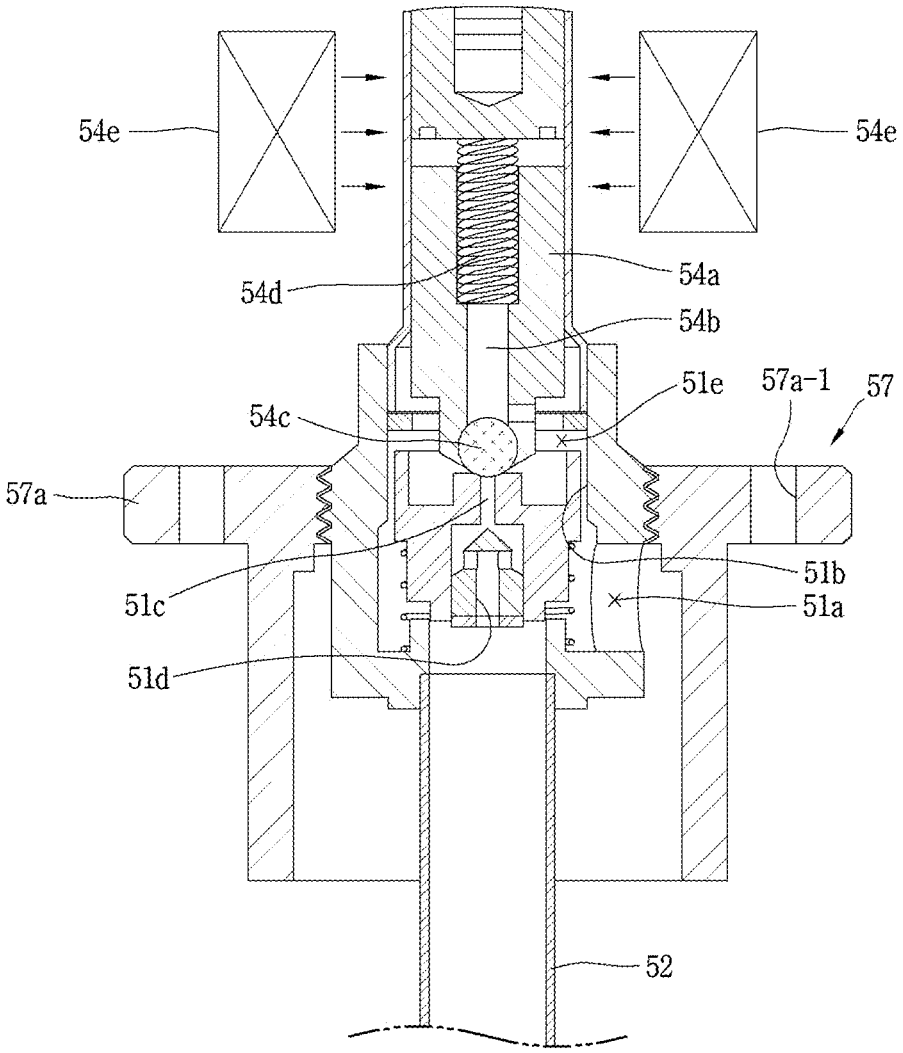
FIG. 16 is a conceptual diagram illustrating an example of mounting the coil on an outer circumference of the cylinder.
Figure 17:
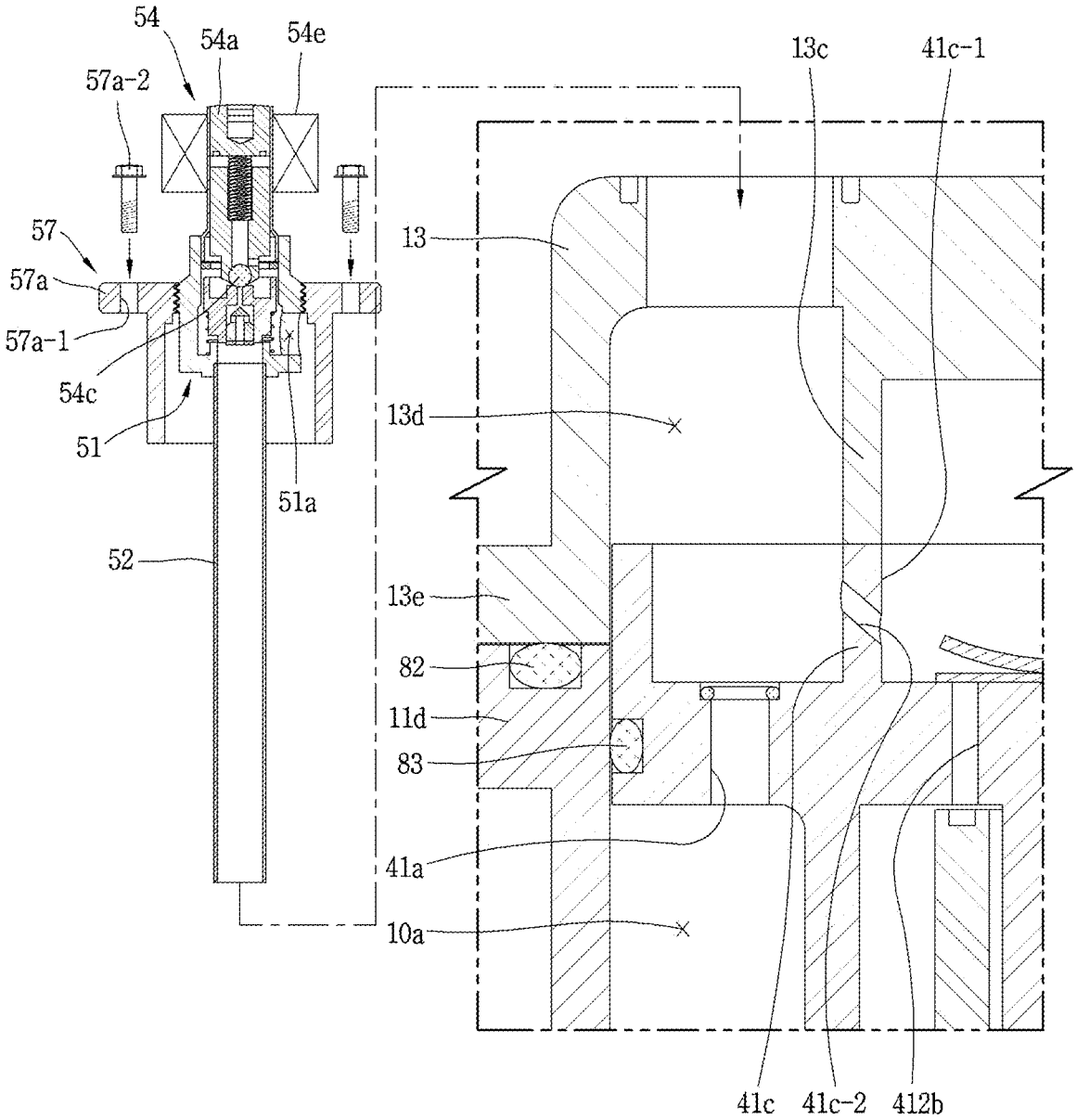
FIG. 17 is a conceptual diagram illustrating an example of assembling the variable-capacity member to the rear housing and the fixed scroll.

FIG. 15 is a conceptual diagram illustrating an example of assembling the valve portion 54 and the flow path distribution portion 51 into the mounting part. FIG. 16 is a conceptual diagram illustrating an example of mounting the coil 54*e* on an outer circumference of the cylinder 54*e*. FIG. 17 is a conceptual diagram illustrating an example of assembling the variable-capacity member 50 to the rear housing 13 and the fixed scroll 40.

Hereinafter, referring to FIGS. 10 to 10B, a method of manufacturing the scroll compressor 100 in the present disclosure is described, the method being performed by coupling the coupling member 57 to the housing 10 using screwing or bolting.

The method of manufacturing the scroll compressor 100 in the present disclosure includes: coupling the valve portion 54 and the flow path distribution portion 51, coupled to each other, to the coupling member 57 (s10); mounting the coil 54*e* on an outer circumference of the valve portion 54 (s20); and coupling the coupling member 57 to one surface of the housing 10 (s30).

The coupling of the valve portion 54 and the flow path distribution portion 51 to the coupling member 57 (s10) may include screwing an outer circumference of the flow path distribution portion 51 to an inner circumference of the coupling member 57 (s13).

By doing so, the flow path distribution portion 51 may be allowed to be screwed to an inner circumference of the flange portion 57*a* of the coupling member 57, and the flow path distribution portion 51 may constitute a structure of being screwed to the housing 10 through the inner circumference of the flange portion 57*a* of the coupling member 57 to obtain a structure without a separate suction flow path or pipe.

The coupling of the coupling member 57 to the one surface of the housing 10 (s30) may include screwing an inner circumference of a coupling hole of the housing 10 to an outer circumference of the coupling member 57 (s31).

Thus, the coupling member 57 may be allowed to screwed to the housing 10, and constitute a structure without a separate suction flow path or pipe.

Desirably, the coupling of the coupling member 57 to the one surface of the housing 10 (s30) may include inserting the coupling member 57 into a coupling hole of the housing 10 (s35) and bolting the flange portion 57*a* of the coupling member 57 to the one surface of the housing 10 (s37).

Thus, the coupling member 57 may be allowed to be bolted to the housing 10, and a structure without a separate suction path or pipe may be defined.

The aforementioned scroll compressor 100 and the method of manufacturing the same are not limited to the configuration and the method of the embodiments described above, but the embodiments may be configured such that all or some of the embodiments are selectively combined so that various modifications can be made.

It will be apparent to those skilled in the art that the present disclosure may be embodied in other specific forms without departing from the spirit or essential characteristics thereof. The above detailed description should not be limitedly construed in all aspects and should be considered as illustrative. Therefore, all changes and modifications that fall within the metes and bounds of the claims, or equivalents of such metes and bounds are therefore intended to be embraced by the appended claims.

Industrial Applicability

The present disclosure may be used for a scroll compressor simplified by changing a structure in which a valve is installed and a refrigerant flow path supplied to the valve, and a method of manufacturing the scroll compressor.

The invention claimed is:

1. A scroll compressor, comprising:

a housing having a suction space in which a flow path, into which a refrigerant is sucked, is defined, and a flow path accommodation space allowing communication between a compression chamber and the suction space;

a rotary shaft installed inside the housing to rotate;

a compression part having an orbiting scroll orbitally installed on the rotary shaft and a fixed scroll coupled to the orbiting scroll to engage with the orbiting scroll to define the compression chamber between the orbiting scroll and the fixed scroll so that the refrigerant is dischargeable; and a variable-capacity member installed in the housing to allow communication with the flow path accommodation space and configured to open or close at least a part of a flow path disposed inside so that some of a refrigerant compressed in the compression chamber is bypassed to the suction space through the flow path accommodation space inside the housing, wherein the variable-capacity member comprises:

a flow path distribution portion configured to receive and accommodate the some of the refrigerant being compressed in the compression chamber to be provided to the suction space;

a valve portion coupled to one side of the flow path distribution portion to open or close a part of the flow path distribution portion to provide the some of the refrigerant accommodated in the flow path distribution portion to the suction space; and a coupling member coupled to a side portion of the flow path distribution portion and coupled to one side of the housing so that the flow path distribution portion is fixable to the one side of the housing.

2. The scroll compressor of claim 1, wherein a screw thread is disposed on an outer circumference of the flow path distribution portion to protrude, and a screw thread is disposed on an inner circumference of the coupling member to be screwed to the screw thread disposed on the outer circumference of the flow path distribution portion.

3. The scroll compressor of claim 2, wherein the coupling member comprises a flange portion placed outside the housing and disposed to protrude from an outer circumference at one end, and the screw thread on the inner circumference of the coupling member is disposed on an inner circumference of the flange portion.

4. The scroll compressor of claim 1, wherein a coupling hole is disposed through one surface of the housing and has a screw thread disposed on an inner circumference, and the coupling member has a screw thread on an outer circumference to be screwed to the inner circumference of the coupling hole.

5. The scroll compressor of claim 1, wherein the housing has a coupling hole which is disposed through one surface of the housing and into which the coupling member is inserted, the coupling member comprises a flange portion placed outside the housing and disposed to protrude from an outer circumference at one end, the flange portion is equipped with a bolt coupling hole in which a bolt is accommodated, and a bolt hole in communication with the bolt coupling hole is disposed in one surface of the housing, and bolts are fastened into the bolt coupling hole and the bolt hole to couple the coupling member to the one surface of the housing by the bolts.

6. The scroll compressor of claim 1, wherein the flow path distribution portion is placed inside the housing to communicate with an inner side of the housing, and the valve portion is coupled to the flow path distribution portion to be disposed to protrude toward outside of the housing.

7. The scroll compressor of claim 1, wherein the flow path distribution portion and the valve portion are disposed inside the housing.

8. The scroll compressor of claim 7, wherein the fixed scroll has a flow path distribution accommodating portion disposed concavely on one surface, opposite to a side in which the compression chamber is disposed, such that the flow path distribution portion is inserted into the one surface, and the flow path distribution portion is coupled to the flow path distribution accommodating portion.

9. The scroll compressor of claim 8, wherein the flow path distribution portion has a screw thread on an outer circumference and the flow path distribution accommodating portion has a screw thread on an inner circumference, and the flow path distribution portion is screwed to the flow path distribution accommodating portion.

10. The scroll compressor of claim 7, wherein the flow path distribution portion comprises:

an inlet portion having one open side into which a refrigerant under an intermediate pressure in the compression chamber is received and introduced;

an inlet flow path which communicates with the inlet portion and into which a refrigerant provided from the inlet portion flows;

an outlet flow path which communicates with the inlet flow path and through which the flowing refrigerant flows out into the suction space; and a blocking portion disposed between the inlet flow path and the outlet flow path and capable of being opened or closed by the valve portion.

11. The scroll compressor of claim 10, wherein the flow path distribution portion has one end coupled to a communication tube being in communication between the outlet flow path and the suction space, the one end being connected to the outlet flow path.

12. The scroll compressor of claim 10, wherein a bypass guide groove in communication with an intermediate pressure chamber of the compression chamber and defined by inside of the housing is disposed in one surface of the fixed scroll, and an inlet hole in communication between the inlet portion and the bypass guide groove is disposed in the flow path distribution accommodating portion.

13. The scroll compressor of claim 1, wherein a guide portion configured to guide introduction of the refrigerant into the flow path distribution portion is disposed on an inner circumference of the coupling member.

14. A method of manufacturing the scroll compressor of claim 1, the method comprising:

coupling the valve portion and the flow path distribution portion, coupled to each other, to the coupling member;

mounting a coil to an outer circumference of the valve portion; and coupling the coupling member to one surface of a housing.

15. The method of claim 14, wherein the coupling of the valve portion and the flow path distribution portion to the coupling member comprises screwing an outer circumference of the flow path distribution portion to an inner circumference of the coupling member.

16. The method of claim 14, wherein the coupling of the coupling member to the one surface of the housing comprises screwing an inner circumference of a coupling hole of the housing to an outer circumference of the coupling member.

17. The method of claim 14, wherein the coupling of the coupling member to the one surface of the housing comprises:

inserting the coupling member into a coupling hole of the housing; and bolting a flange portion of the coupling member to the one surface of the housing.

18. A scroll compressor, comprising:

a housing having a suction space in which a flow path, into which a refrigerant is sucked, is defined, and a flow path accommodation space allowing communication between a compression chamber and the suction space;

a rotary shaft installed inside the housing to rotate;

a compression part having an orbiting scroll orbitally installed on the rotary shaft and a fixed scroll coupled to the orbiting scroll to engage with the orbiting scroll to define the compression chamber between the orbiting scroll and the fixed scroll so that the refrigerant is dischargeable; and a variable-capacity member installed in the housing to allow communication with the flow path accommodation space and configured to open or close at least a part of a flow path disposed inside so that some of a refrigerant compressed in the compression chamber is bypassed to the suction space through the flow path accommodation space inside the housing, wherein the variable-capacity member comprises:

a flow path distribution portion configured to receive and accommodate the some of the refrigerant being compressed in the compression chamber to be provided to the suction space; and a valve portion coupled to one side of the flow path distribution portion to open or close a part of the flow path distribution portion to provide the some of the refrigerant accommodated in the flow path distribution portion to the suction space, and wherein the flow path distribution portion comprises:

an inlet portion having one open side into which a refrigerant under an intermediate pressure in the compression chamber is received and introduced;

an inlet flow path which communicates with the inlet portion and into which a refrigerant provided from the inlet portion flows;

an outlet flow path which communicates with the inlet flow path and through which the flowing refrigerant flows out into the suction space; and a blocking portion disposed between the inlet flow path and the outlet flow path and capable of being opened or closed by the valve portion.

19. The scroll compressor of claim 18, wherein the flow path distribution portion has one end coupled to a communication tube being in communication between the outlet flow path and the suction space, the one end being connected to the outlet flow path.

20. The scroll compressor of claim 19, wherein the flow path accommodation space is defined by one side of the fixed scroll and an inner side of the housing, the one side being opposite to another side of the fixed scroll toward which the orbiting scroll is disposed, the suction space is disposed between the compression part and a side portion of the housing, a communication hole is disposed in the fixed scroll to communicate between the flow path accommodation space and the suction space, and the communication tube is inserted into the communication hole.

21. The scroll compressor of claim 20, wherein a bypass guide groove in communication with the compression chamber and defined by inside of the housing is disposed in the one side of the fixed scroll, the one side being opposite to the another side of the fixed scroll toward which the orbiting scroll is disposed, and an inlet hole in communication with the flow path accommodation space is disposed in the bypass guiding groove.

* * * * *